US007270151B2

(12) United States Patent
Nagura et al.

(10) Patent No.: US 7,270,151 B2
(45) Date of Patent: Sep. 18, 2007

(54) INDUSTRIAL TWO-LAYER FABRIC

(75) Inventors: Hiroyuki Nagura, Shizuoka (JP); Ikuo Ueda, Shizuoka (JP); Keiichi Takimoto, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 0 days.

(21) Appl. No.: 11/207,942

(22) Filed: Aug. 22, 2005

(65) Prior Publication Data

US 2006/0040578 A1 Feb. 23, 2006

(30) Foreign Application Priority Data

Aug. 23, 2004 (JP) ..... 2004-242258

(51) Int. Cl.

| | |
|---|---|
| ***D21F 1/10*** | (2006.01) |
| ***D21F 7/08*** | (2006.01) |
| ***D03D 11/00*** | (2006.01) |
| ***D03D 3/04*** | (2006.01) |
| *D03D 25/00* | (2006.01) |

(52) U.S. Cl. ..... 139/383 A; 139/383 AA; 139/408; 139/413; 162/358.2; 162/900; 162/902; 162/903

(58) Field of Classification Search ..... 139/383 A, 139/383 AA, 408, 413; 162/358.2, 900, 162/902, 903

See application file for complete search history.

(56) References Cited

U.S. PATENT DOCUMENTS

| | | | | |
|---|---|---|---|---|
| 4,376,455 | A * | 3/1983 | Hahn | 139/383 A |
| 4,515,853 | A * | 5/1985 | Borel | 442/205 |
| 5,022,441 | A * | 6/1991 | Tate et al. | 139/383 A |
| 5,025,839 | A | 6/1991 | Wright | |
| 5,103,875 | A * | 4/1992 | Tate et al. | 139/383 A |
| 5,487,414 | A * | 1/1996 | Kuji et al. | 139/383 A |
| 5,490,543 | A * | 2/1996 | Fujisawa | 139/383 A |
| 6,510,873 | B2 * | 1/2003 | Nagura | 139/383 A |
| 7,073,539 | B2 * | 7/2006 | Takimoto et al. | 139/383 A |
| 7,108,019 | B2 * | 9/2006 | Nagura et al. | 139/383 A |
| 2004/0089365 | A1 * | 5/2004 | Heger et al. | 139/383 A |
| 2005/0229995 | A1 * | 10/2005 | Ito et al. | 139/383 A |
| 2006/0048839 | A1 * | 3/2006 | Fujisawa | 139/383 A |

OTHER PUBLICATIONS

European Search Report dated Sep. 29, 2006.

* cited by examiner

*Primary Examiner*—Robert H Muromoto, Jr.
(74) *Attorney, Agent, or Firm*—Rader, Fishman & Grauer PLLC

(57) ABSTRACT

An industrial two-layer fabric which comprises eight pairs of warps obtained by arranging eight upper surface side warps and eight lower surface side warps, and a plurality of upper surface side wefts and lower surface side wefts, and has an upper surface side layer and a lower surface side layer bound with warp-direction yarns. In the lower surface side layer, warps are formed by successively arranging a design in which one warp passes over four successive lower surface side wefts, passes under one lower surface side weft, passes over two lower surface side wefts, and passes under one lower surface side weft while shifting the design by three lower surface side wefts, and two adjacent lower surface side warps simultaneously weave therein, from the lower surface side, one lower surface side weft.

11 Claims, 21 Drawing Sheets

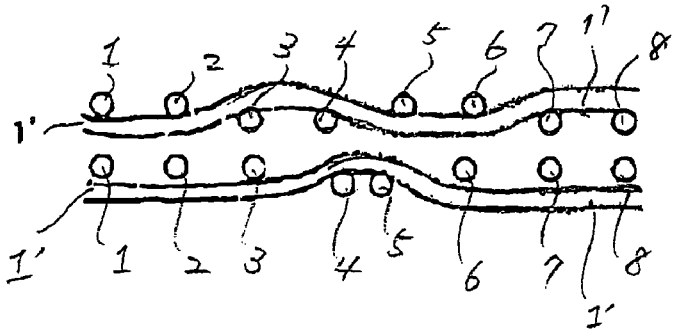
FIG. 3
FIG. 4
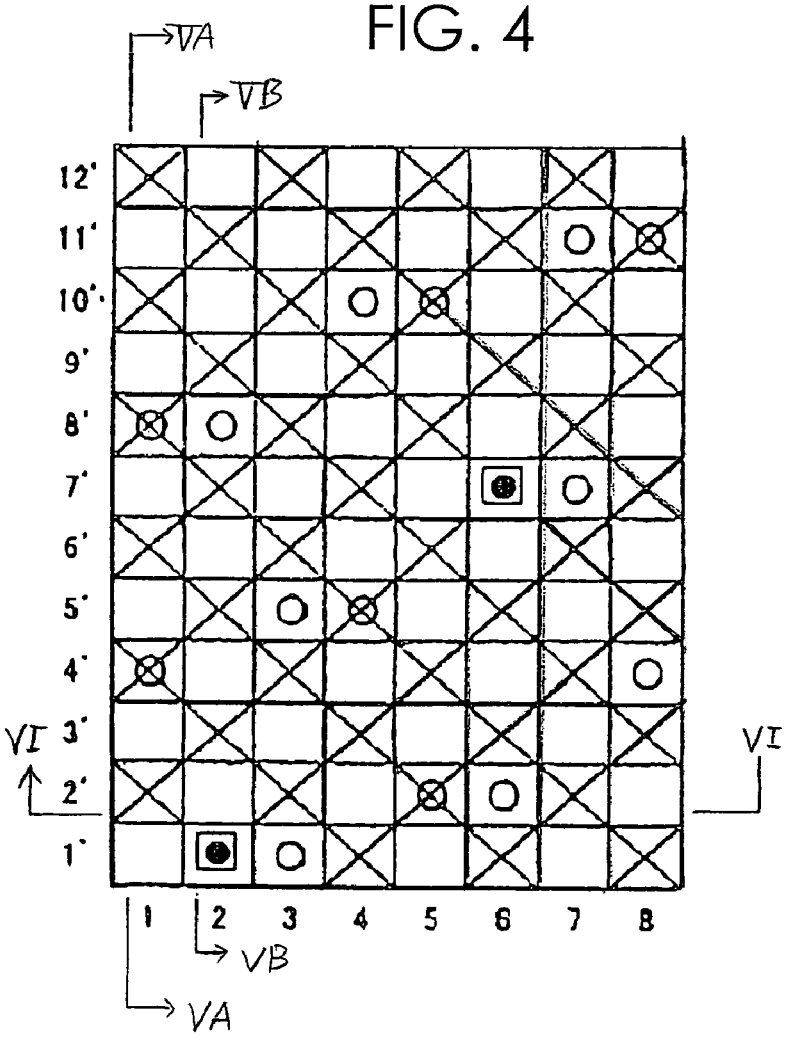

INDUSTRIAL TWO-LAYER FABRIC

TECHNICAL FIELD OF THE INVENTION

The present invention relates to an industrial two-layer fabric used for transport, dehydration and the like, particularly suited for papermaking.

BACKGROUND ART

Fabrics obtained by weaving warps and wefts have conventionally been used widely as an industrial fabric. They are, for example, used in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough rigidity and therefore are usable desirably even under severe environments, or are capable of maintaining conditions necessary for making good paper for a prolonged period of time. In addition, fiber supporting property, improvement in a papermaking yield, good water drainage property, wear resistance, dimensional stability and running stability are demanded. In recent years, owing to the speed-up of a papermaking machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by use of the papermaking fabric as a representative example.

In the paper making machine, an increase in paper making speed inevitably raises dehydration speed so that dehydration power must be reinforced. Examples of the fabric with good dehydration property include two-layer fabric having a dehydration hole penetrating from the upper surface side toward the lower surface side of the fabric. Particularly, a two-layer fabric using a warp binding yarn which is woven with an upper surface side weft and a lower surface side weft to constitute the upper surface side surface design and the lower surface side surface design is developed with a view to satisfying the surface property, fiber supporting property and dehydration property which a papermaking fabric is required to have. A two-layer fabric using a warp binding yarn is described in Japanese Patent Laid-Open No. 2004-36052. In the fabric disclosed in the above-described invention, a warp functions as a binding yarn for weaving the upper surface side layer with the lower surface side layer. A pair of two warp binding yarns simultaneously and mutually complement a portion of the upper surface side surface design and a portion of the lower surface side surface design to form each surface design so that the fabric has excellent surface property and binding strength. The lower surface side design of the fabric in Examples 1 to 3 of Japanese Patent Laid-Open No. 2004-36052 is however a ribbed design in which two lower surface side warps are arranged in parallel while having the same design and a crimp of a lower surface side weft corresponds to only two warps so that the fabric has poor wear resistance.

SUMMARY OF THE INVENTION

The above-described two-layer fabric has dehydration holes penetrating completely from the upper surface side layer toward the lower surface side layer and these holes are arranged over the whole surface so that the fabric has good dehydration property. They are however such drawbacks as sticking, into the fiber, of a sheet raw material over a wire or loss of fiber or filler owing to strong vacuum, which sometimes leads to remarkable generation of dehydration marks.

Thus, industrial fabrics capable of satisfying all of the surface property, fiber supporting property and wear resistance have not yet been developed.

With the foregoing problems in view, the present invention has been made. An object of the present invention is to provide an industrial fabric capable of preventing drastic dehydration and generation of dehydration marks resulting therefrom and having excellent surface property, fiber supporting property and wear resistance.

The present invention relates to an industrial two-layer fabric which comprises eight pairs of warps obtained by arranging eight upper surface side warps and eight lower surface side warps, and a plurality of upper surface side wefts and lower surface side wefts, and has an upper surface side layer and a lower surface side layer bound with warp-direction yarns. In the lower surface side layer, warps are formed by successively arranging a design in which one warp passes over four successive lower surface side wefts, passes under one lower surface side weft, passes over two lower surface side wefts, and passes under one lower surface side weft while shifting the design by three lower surface side wefts, and two adjacent lower surface side warps simultaneously weave therein, from the lower surface side, one lower surface side weft, thereby forming a weft long crimp of the lower surface side weft corresponding to six lower surface side warps over the lower surface side surface and at the same time, arranging a lower surface side warp in a zigzag manner while alternately adjoining the lower surface side warps on both sides adjacent thereto.

The upper surface side warp(s) and lower surface side warp(s) of at least one of the eight pairs of an upper surface side warp and a lower surface side warp arranged vertically may be both warp binding yarns which are woven with an upper surface side weft and a lower surface side weft to constitute a portion of an upper surface side surface design and a portion of a lower surface side surface design. The warp binding yarns forming the pair may be woven with respective upper surface side wefts and cooperatively function as one warp constituting an upper surface side complete design on an upper surface side surface, while on the lower surface side surface, the pair of warp binding yarns constitute a lower surface side surface design similar to that constituted by a lower surface side warp.

The upper surface side warp(s) of at least one of the eight pairs of an upper surface side warp and a lower surface side warp arranged vertically may be each a warp binding yarn which is woven with an upper surface side weft and a lower surface side weft to constitute a portion of an upper surface side surface design and a portion of a lower surface side surface design; in the pair of the warp binding yarn and lower surface side warp, the warp binding yarn may be woven with an upper surface side weft to functions as one warp constituting an upper surface side complete design on an upper surface side surface, while on the lower surface side surface, the pair of the warp binding yarn and lower surface side warp cooperatively constitutes a lower surface side surface design similar to that constituted by the other lower surface side warps.

The lower surface side warp(s) of at least one of the eight pairs of an upper surface side warp and a lower surface side warp arranged vertically may be a warp binding yarn which is woven with an upper surface side weft and a lower surface side weft to constitute a portion of an upper surface side surface design and a portion of a lower surface side surface design. In the pair of the warp binding yarn and the upper surface side warp, the warp binding yarn and upper surface side warp may be woven with respective upper surface side wefts and cooperatively function as one warp constituting an upper surface side complete design on an upper surface side surface, while on the lower surface side surface, the warp binding yarn constitutes a lower surface side surface design similar to that constituted by a lower surface side warp.

One of the warp binding yarns forming the pair may be woven with at least one upper surface side weft to form an upper surface side surface design, under which the other warp binding yarn may be woven with one lower surface side weft, while the one warp binding yarn may be woven with one lower surface side weft, over which the other warp binding yarn may be woven with at least one upper surface side weft to constitute the upper surface side surface design, whereby the pair of warp binding yarns mutually complement the upper surface side surface design and lower surface side surface design, thereby forming each surface design.

The upper surface side complete design may be composed of either one warp complete design or of at least two warp complete designs. The upper surface side surface design may be any one of 2-shaft plain weave, 4-shaft twill weave, 4-shaft broken twill weave, 8-shaft twill weave and 8-shaft broken twill weave.

One or at least two auxiliary wefts may be inserted between upper surface side wefts. The number of upper surface side wefts may be 1 to 2 times the number of lower surface side wefts. The diameter of an upper surface side warp may be equal to that of a lower surface side warp.

In an industrial two-layer fabric which comprises eight pairs of warps obtained by vertically arranging eight upper surface side warps and eight lower surface side warps, and a plurality of upper surface side wefts and lower surface side wefts, and has an upper surface side layer and a lower surface side layer bound with warp-direction yarns, the lower surface side layer is formed in such a manner that warps are formed with a complete design obtained by successively arranging a design in which one warp passes over four successive lower surface side wefts, passes under one lower surface side weft, passes over two lower surface side wefts, and passes under one lower surface side weft, while shifting this design by three lower surface side wefts; two adjacent lower surface side warps simultaneously weave therein, from the lower surface side, one lower surface side weft, thereby forming a weft long crimp of a lower surface side weft corresponding to six lower surface side warps on the lower surface side surface and at the same time, arranging a lower surface side warp in a zigzag manner while adjoining the lower surface side warps on both sides adjacent thereto. This makes it possible to improve the rigidity, oblique rigidity and wear resistance of the fabric. Moreover, since water drainage property is made uneven by forming both an overlapped portion and a non-overlapped portion between warp-direction yarns constituting the upper surface side layer and warp-direction yarns constituting the lower surface side layer, dehydration occurs stepwise and therefore, generation of dehydration marks, sticking of a sheet raw material on a wire, loss of fiber or filler can be suppressed.

BRIEF DESCRIPTION OF THE DRAWINGS

FIG. 3 is a cross—sectional view along the line III—III at the weft 1' of FIG. 1.

FIG. 4 is a design diagram illustrating the complete design of Example 2 of the present invention.

DETAILED DESCRIPTION OF THE INVENTION

Figure 1:
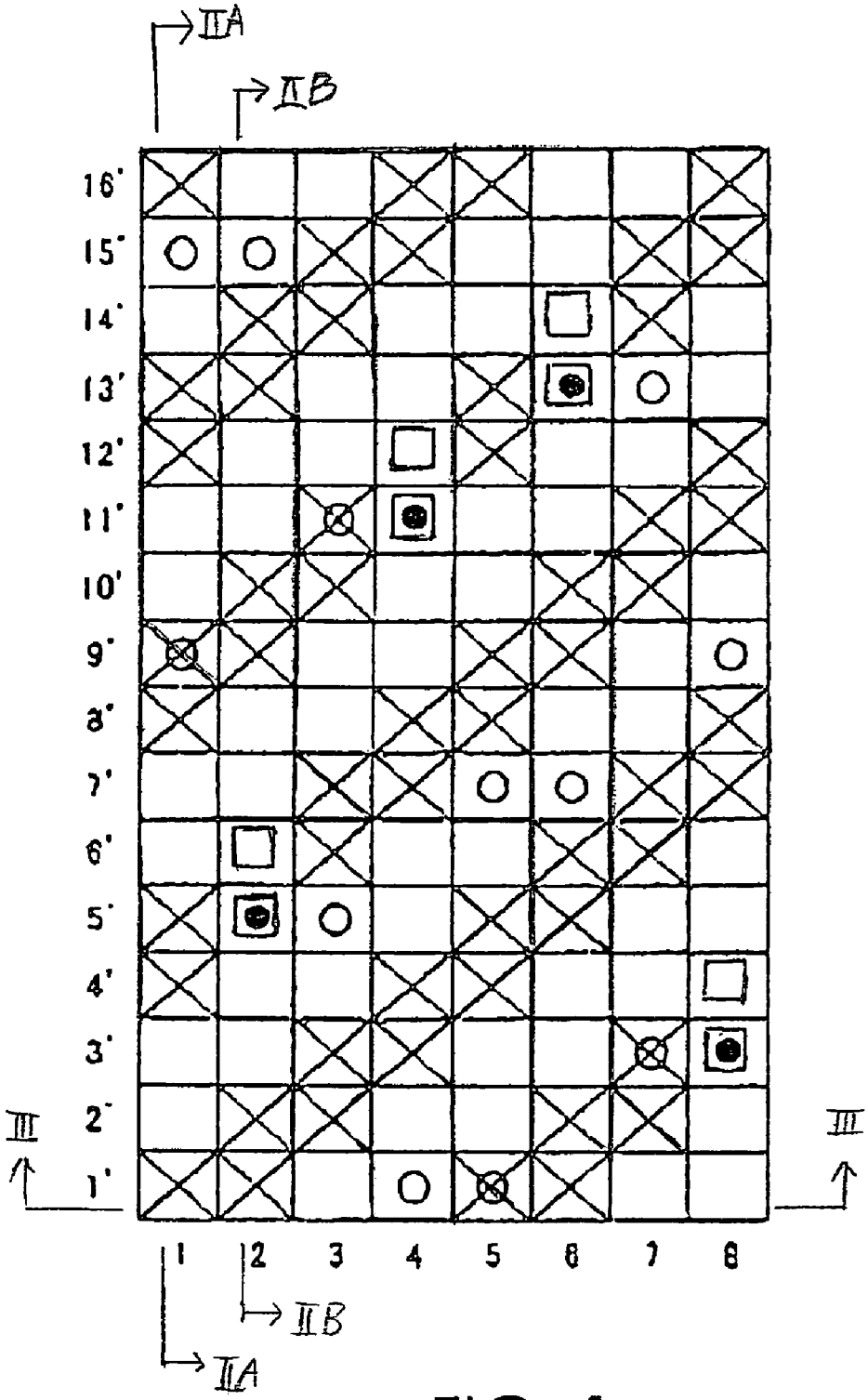
FIG. 1 is a design diagram illustrating the complete design of Example 1 of the present invention.

The present invention provides an industrial two-layer fabric which comprises eight pairs of warps obtained by vertically arranging eight upper surface side warps and eight lower surface side warps, and a plurality of upper surface side wefts and lower surface side wefts, and has an upper surface side layer and a lower surface side layer bound with warp-direction yarns, characterized in that in the lower surface side layer, warps have a design in which one warp passes over four successive lower surface side wefts, passes under one lower surface side weft, passes over two successive lower surface side wefts, and passes under one lower surface side weft; a lower surface side warp adjacent to the above-described one is formed by arranging the above-described design while shifting it by three upper surface side wefts; two adjacent lower surface side warps simultaneously weave therein, from the lower surface side, one lower surface side weft, thereby forming a weft long crimp corresponding to six lower surface side warps over the lower surface side surface and at the same time, arranging a lower surface side warp in a zigzag manner while alternately adjoining the lower surface side warps on both sides adjacent thereto.

Two adjacent lower surface side warps firmly weave therein a lower surface side weft so that the resulting fabric has excellent rigidity. In addition, a weft long crimp corresponding to six lower surface side warps is formed on the lower surface side surface so that the resulting fabric has improved wear resistance. Moreover, the number of weaving times of a lower surface side weft with a warp is small so that it is possible to increase the shooting count of the lower surface side weft or widen its diameter. An overlapped portion and a non-overlapped portion between warp-direction yarns constituting the upper surface side layer and warp-direction yarns constituting the lower surface side layer are caused to exist as a mixture by employing a design in which a lower surface side warp is zigzag arranged while adjoining lower surface side warps on both sides adjacent thereto. Owing to this structure, a network having a free size or shape can be formed, which permits stepwise progress of dehydration and makes it possible to inhibit generation of dehydration marks, sticking of a sheet raw material on a wire and loss of fiber or filler. Moreover, the resulting fabric has improved rigidity in its oblique direction by arranging lower surface side warps in a zigzag manner.

The industrial two-layer fabric of the present invention is composed of eight pairs of warps obtained by arranging eight upper surface side warps and eight lower surface side warps vertically, and a plurality of upper surface side wefts and lower surface side wefts. As a binding yarn for weaving the upper surface side layer with the lower surface side layer, employed is a warp binding yarn woven with an upper surface side weft and a lower surface side weft to constitute a portion of an upper surface side surface design and a portion of a lower surface side surface design.

The warp binding yarn is arranged in any one of the following manners: at least one pair, of eight pairs of an upper surface side warp and a lower surface side warp vertically arranged, has two warp binding yarns instead of the upper surface side warp and lower surface side warp; at least one pair, of eight pairs of an upper surface side warp and a lower surface side warp vertically arranged, has a warp binding yarn, which has been substituted for the upper surface side warp, and the lower surface side warp; and at least one pair, of eight pairs of an upper surface side warp and a lower surface side warp vertically arranged, has a warp binding yarn, which has been substituted for the lower surface side warp, and the upper surface side warp. The term "pair" as used herein means a pair of one upper surface side warp and one lower surface side warp vertically arranged and to be woven with an upper surface side weft and a lower surface side weft, respectively. In the present invention, eight upper surface side warps and eight lower surface side warps constitute eight pairs.

When two warp binding yarns form a pair, they are woven with respective upper surface side wefts and cooperatively function as one warp constituting an upper surface side complete design on the upper surface side surface, while on the lower surface side surface, they form a lower surface side surface design similar to that formed by another lower surface side warp. Particularly in this design, one of the warp binding yarns forming the pair is woven with at least one upper surface side weft to form an upper surface side surface design, under which the other warp binding yarn is woven with one lower surface side weft, while the one warp binding yarn is woven with one lower surface side weft, over which the other warp binding yarn is woven at least one upper surface side weft to constitute the upper surface side surface design. Thus, the pair of warp binding yarns is able to form the upper surface side surface design and lower surface side surface design by mutually complement them.

In the case of the pair of a warp binding yarn and a lower surface side warp, the warp binding yarn is woven with an upper surface side weft and functions as one warp constituting an upper surface side complete design on the upper surface side surface, while on the lower surface side surface, the warp binding yarn and lower surface side warp cooperatively form a lower surface side surface design similar to that formed by another lower surface side warp.

In the case of the pair of a warp binding yarn and an upper surface side warp, the warp binding yarn and upper surface side warp are woven with respective upper surface side wefts and cooperatively function as one warp constituting an upper surface side complete design on the upper surface side surface, while on the lower surface side surface, the warp binding yarn forms a lower surface side surface design similar to that formed by a lower surface side warp.

In the fabric of the present invention, binding is achieved by a warp binding yarn extending in a warp direction. The yarn serving as a binding yarn is a warp-direction one constantly under tension. Compared with a conventional thin weft binding yarn, it has a very strong power for binding the upper surface side layer and the lower surface side layer and has good adhesion. Accordingly, problems such as weakening of a binding power owing to internal wear caused by friction between these two layers, appearance of a space between layers and separation of two layers scarcely occur. In addition, since an additional binding yarn such as weft binding yarn is not necessary, it is possible to increase the shooting count of wefts or widen the diameter of a weft, which leads to improvement in the rigidity of a whole fabric.

The lower surface side complete design composed of warp binding yarns, lower surface side warps and lower surface side wefts is formed by successively arranging a design in which a warp passes over four successive lower surface side wefts, passes under one lower surface side weft, passes over two lower surface side wefts and passes under one lower surface side weft, while shifting this design by three lower surface side wefts. All the warp designs constituting the lower surface side complete design are the same. In other words, a pair of warp binding yarns also forms a lower surface side surface design similar to that formed by a lower surface side warp. The pair of a warp binding yarn and a lower surface side warp and the pair of a warp binding yarn and an upper surface side warp each forms a lower surface side surface design similar to that formed by a lower surface side warp.

No particular limitation is imposed on the upper surface side complete design composed of warp binding yarns, upper surface side warps and upper surface side wefts. The warp binding yarns forming the pair may be woven with respective upper surface side wefts and cooperatively function as one warp constituting the upper surface side complete design. This also applies to the pair of a warp binding yarn and an upper surface side warp and they may cooperatively function as a warp constituting the upper surface side complete design. In the case of the pair of a warp binding yarn and a lower surface side warp, the lower surface side warp is not woven with an upper surface side weft so that only the warp binding yarn may be woven with an upper surface side weft to function as a warp. One or at least two warp complete designs may form the upper surface side complete design. For example, they may be any one of a 1/3 design in which an upper surface side warp passes over one upper surface side weft and then passes under three successive upper surface side wefts, a 2/2 design in which an upper surface side warp passes over two upper surface side wefts and passes under two successive upper surface side wefts, and a design having both the 1/3 design and 2/2 design on one upper surface side surface. The design can be selected as needed. Preferred examples include 2-shaft plain weave, 4-shaft twill weave, 4-shaft broken twill weave, 8-shaft twill weave and 8-shart broken twill weave.

One or at least two auxiliary wefts may be placed between upper surface side wefts. The auxiliary weft, together with an upper surface side weft, forms the upper surface side surface design, fills the space between the upper surface side wefts, thereby improving the fiber supporting property, and flattens the irregularities which are otherwise formed by a weft knuckle, thereby improving the surface property. No particular limitation is imposed on the design formed by the auxiliary weft and it can be selected depending on the application or using purpose. In order to improve the fiber supporting property, it is recommended to adopt a design in which a long crimp by auxiliary wefts is formed between upper surface side wefts. No particular limitation is imposed on the diameter of the auxiliary weft, but it is preferred to set it smaller than that of an upper surface side weft. Although no particular limitation is imposed on the ratio of auxiliary wefts, a ratio of upper surface side wefts and auxiliary wefts may be 1:1, 2:1, 3:2 or the like. Although no particular limitation is imposed on the arrangement ratio of warp binding yarns, it is necessary to place at least one warp binding yarn because it serves as a binding yarn. The fabric of the present invention has eight pairs of warps having eight upper surface side warps and eight lower surface side warps arranged vertically, so that the four pairs of an upper surface side warp and a lower surface side warp, out of eight pairs, are replaced with pairs of warp binding yarns and the pair of warp binding yarns and the pair of an upper surface side warp and a lower surface side warp may be arranged alternately; or the pair of a warp binding yarn and a lower surface side warp and the pair of an upper surface side warp and a lower surface side warp may be arranged at a ratio of 1:3. The number of warp binding yarns may be increased to improve the binding strength. The ratio of warp binding yarns can be selected as needed, depending on the weaving conditions, using purpose, or the like.

A ratio of an upper surface side weft and a lower surface side weft may be 2:1, 1:1, 3:2 or the like. At 2:1 or 3:2 which means dense arrangement of upper surface side wefts and rough arrangement of lower surface side wefts, the fabric has improved wear resistance, because the diameter of the lower surface side weft can be thickened easily.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, marled yarn and yarns obtained by intertwining them. As the cross-section of the yarn, not only circular form but also square or short form such as stellar form, or elliptical or hollow form can be used. The material of the yarn can be selected freely and usable examples of it include polyester, nylon, polyphenylene sulfide, polyvinylidene fluoride, ethylene tetrafluoride, polypropylene, aramid, polyether ether ketone, polyethylene naphthalate, cotton, wool and metal. Of course, yarns obtained using copolymers or incorporating or mixing the above-described material with a substance selected depending on the intended purpose may be used.

As the upper surface side warps, lower surface side warps, upper surface side wefts and warp binding yarns, use of a polyester monofilament having rigidity and excellent dimensional stability is usually preferred. When lower surface side wefts which need wear resistance are obtained by interweaving of polyester monofilaments and polyamide monofilaments while arranging them alternately, they are able to have wear resistance without losing rigidity.

It is also possible to place a plurality of yarns with the same design at a position where one yarn is normally placed from the standpoint of design. Arrangement of a plurality of yarns having a thin diameter brings about improvement in surface property and thinning of the fabric.

EXAMPLES

Examples of the present invention will hereinafter be described based on accompanying drawings.

FIGS. 1, 4, 7, 10, 13, 16, 19, 22, 25, 28 and 31 are design diagrams illustrating the complete design of the examples of the present invention. The term "complete design" as used herein means a minimum repeating unit of a fabric design and a whole fabric design is formed by connecting this complete design longitudinally and latitudinally. In these design diagrams, warps are indicated by Arabic numerals, for example 1, 2 and 3, while wefts are indicated by Arabic numerals with a prime, for example, 1', 2' and 3'.

In the diagrams, a cross "x" means that an upper surface side warp lies over an upper surface side weft or a warp binding yarn lies over an upper surface side weft, an open circle "○" indicates that a lower surface side warp lies under a lower surface side weft, or a warp binding yarn lies under a lower surface side weft, an open square "□" indicates that a warp binding yarn lies over an upper surface side weft, and a solid circle "•" indicates that a warp binding yarn lies under a lower surface side weft.

Example 1

Figures 2A, 2B:
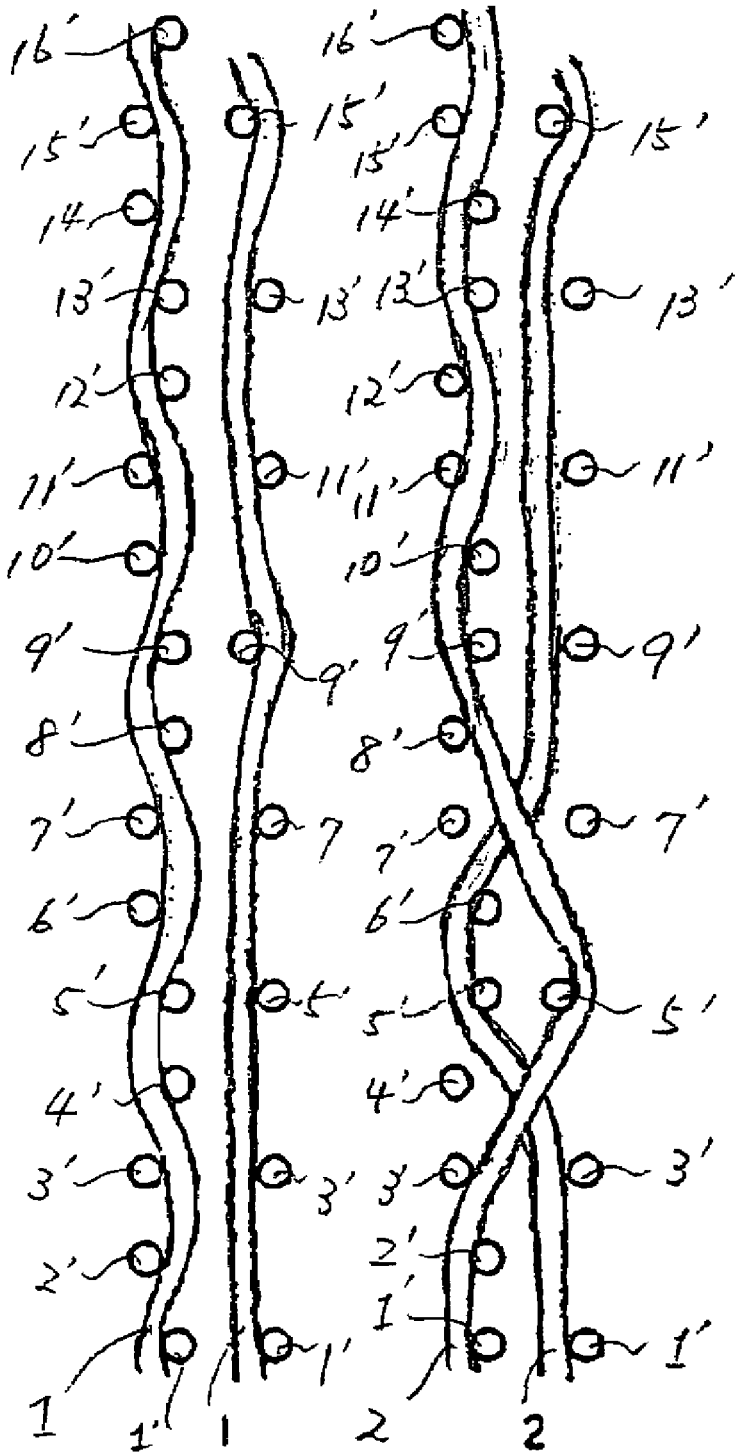
FIGS. 2A and 2B are cross-sectional views along the lines IIA—IIA and IIB—IIB at the warps 1 and 2 of FIG. 1 respectively.

FIG. 1 is a design diagram showing the complete design of Example 1 of the present invention. FIGS. 2A and 2B are cross-sectional views along the lines IIA—IIA and IIB—IIB at the warps 1 and 2 of FIG. 1 respectively. FIG. 3 is a cross-sectional view along the line III—III at the weft 1' of FIG. 1.

In the diagram of FIG. 1, warps indicated by 1, 3, 5 and 7, of eight pairs of an upper surface side warp and a lower surface side warp arranged vertically, are pairs of an upper surface side warp forming an upper surface side surface and a lower surface side warp forming a lower surface side surface arranged vertically, while warps indicated by 2, 4, 6 and 8 are pairs of two warp binding yarns which are woven with upper surface side wefts and lower surface side wefts to form a portion of an upper surface side surface design and a portion of a lower surface side surface design. Wefts indicated by 1', 2', 3' . . . 16' are upper surface side wefts and lower surface side wefts. The lower surface side wefts are located below the upper surface side wefts of the odd number 1', 3', 5', . . . 15', meaning that their density is half of that of the upper surface side wefts. The warp binding yarns weave an upper surface side layer with a lower surface side layer and they do not impair the surface design, because they form each surface design while mutually complementing the upper surface side surface design and lower surface side surface design. A pair of two warp binding yarns and a pair of an upper surface side warp and a lower surface side warp are located alternately one by one. The lower surface side wefts are arranged at a density half of the upper surface side wefts.

A lower surface side warp has a 4/1-2/1 design in which it passes over four successive lower surface side wefts, passes under one lower surface side weft, passes over two successive lower surface side wefts and passes under one lower surface side weft. Described specifically, a lower surface side warp 1 passes over four successive lower surface side wefts 1', 3', 5' and 7', passes under a lower surface side weft 9', passes over two successive lower surface side wefts 11' and 13' and passes under a lower surface side weft 15'.

One of warp binding yarns forming a pair is woven with at least one upper surface side weft to form the upper surface side surface design, below which the other warp binding yarn is woven with one lower surface side weft, while the one warp binding yarn is woven with one lower surface side weft, over which the other warp binding yarn is woven with at least one upper surface side weft to form the upper surface side surface design. These warp binding yarns cooperatively function as one warp constituting an upper surface side complete design. The lower surface side surface design is similar to the 4/1-2/1 design formed by a lower surface side warp. One of warp binding yarns 2 forming a pair is woven with upper surface side wefts 5' and 6', under which the other warp binding yarn is woven with the lower surface side weft 5', while the one warp binding yarn is woven with the lower surface side weft 15', over which the other warp binding yarn is woven with upper surface side wefts 9', 10', 13', 14', 1' and 2'. Thus, the lower surface side surface has a 4/1-2/1 design and the upper surface side surface has a 2/2 design. Warp binding yarns as a pair thus mutually complement the upper surface side surface design and the lower surface side surface design and form each surface design. For example, one of warp binding yarns 2 forms a design in which it passes over the upper surface side wefts 1' and 2', passes between upper surface side wefts 3' and 4' and a lower surface side weft, passes under the lower surface side weft 5', passes between upper surface side wefts 6', 7', 8' and a lower surface side weft, passes over the upper surface side wefts 9' and 10', passes between upper surface side wefts 11' and 12' and a lower surface side weft, passes over the upper surface side wefts 13' and 14' and then passes between upper surface side wefts 15' and 16' and a lower surface side weft. The other one forms a design in which it passes between the upper surface side wefts 1' to 4' and lower surface side wefts, passes over the upper surface side wefts 5' and 6', passes between upper surface side wefts 7' to 14' and lower surface side wefts, passes under the lower surface side weft 15' and then passes between the upper surface side weft 16' and a lower surface side weft. The pair of these two warp binding yarns cooperatively forms, as the upper surface side surface design, a 2/2 design in which they pass over two successive upper surface side wefts and pass under two successive upper surface side wefts, while they form, as the lower surface side surface design, a 4/1-2/1 design in which they pass over four successive lower surface side wefts, pass under one lower surface side weft, pass over two successive lower surface side wefts and then pass under one lower surface side weft. The upper surface side surface design is similar to the 2/2 design formed by the other upper surface side warps and upper surface side wefts, while the lower surface side surface design is similar to the 4/1-2/1 design formed by other lower surface side warps and lower surface side wefts.

In this Example, the warp binding yarn 2 is placed while shifting the design of the lower surface side warp 1 by three lower surface side wefts. A lower surface side warp 3 adjacent to the warp binding yarn 2 is also placed while shifting the design of the warp binding yarn 2 by three lower surface side wefts. By repeating this and arranging them successively, a lower surface side warp and a warp binding yarn which are adjacent to each other simultaneously weave therein one lower surface side weft from the lower surface side, whereby the resulting fabric has improved rigidity. In addition, on the lower surface side surface, a weft long crimp of a lower surface side weft corresponding to six lower surface side warps is formed so that the fabric has improved wear resistance.

By placing the lower surface side warp 1 and the warp binding yarn 2 which are adjacent to each other while shifting the design by three lower surface side wefts and weaving the lower surface side weft 15' from the lower surface side by the lower surface side warp 1 and warp binding yarn 2 simultaneously, a design in which the lower surface side weft 15' passes over two warps, that is, the lower surface side warp 1 and warp binding yarn 2, and then passes under six successive warps, that is, lower surface side warps 3, 5, and 7 and warp binding yarns 4, 6 and 8 is formed.

Simultaneous weaving of a lower surface side weft with a lower surface side warp and a warp binding yarn brings them close to each other. A lower surface side warp and a warp binding yarn are woven with a lower surface side weft twice. The lower surface side warp is woven once with each of two warp binding yarns, which are adjacent thereto on both sides, simultaneously so that it is arranged in a zigzag manner while adjoining them alternately. The warp binding yarn is also woven once with each of two lower surface side warps, which are adjacent thereto on both sides, simultaneously so that it is arranged in a zigzag manner while adjoining them alternately. Accordingly, warp-direction yarns constituting the lower surface side layer are arranged in a zigzag manner.

The above-described arrangement in a zigzag manner will next be described with lower surface side warp 3 and a warp binding yarn 4 as examples. The warp binding yarn 2 and the lower surface side warp 3 are woven simultaneously with the lower surface side weft 5', which brings the warp binding yarn 2 and the lower surface side warp 3 close to each other, while the lower surface side warp 3 and the warp binding yarn 4 are woven simultaneously with the lower surface side weft 11', which brings the lower surface side warp 3 and warp binding yarn 4 close to each other. By this, the lower surface side warp 3 gets close to the warp binding yarn 2 at the intersection with the lower surface side weft 5' and gets close to the warp binding yarn 4 at the intersection with the lower surface side weft 11'. The lower surface side warp is thus arranged in a zigzag manner by repeating this.

The warp binding yarn 4 and the lower surface side warp 5 are woven simultaneously by the lower surface side weft 1', which brings the warp binding yarn 4 and lower surface side warp 5 close to each other, while the lower surface side warp 3 and warp binding yarn 4 are simultaneously woven by the lower surface side weft 11', which brings the lower surface side warp 3 and warp binding yarn 4 closer to each other. By this, the warp binding yarn 4 gets close to the lower surface side warp 3 at the intersection with the lower surface side weft 1' and gets close to the lower surface side warp 5 at the intersection with the lower surface side weft 11'. The lower surface side warp is thus arranged in a zigzag manner by repeating this. The other lower surface side warps and warp binding yarns are also arranged in a zigzag manner while adjoining yarns adjacent thereto alternately, suggesting that warp-direction yarns constituting the lower surface side layer are arranged in a zigzag manner. An overlapped portion and a non-overlapped portion between a warp-direction yarn constituting the upper surface side layer and a warp-direction yarn constituting the lower surface side layer are therefore caused to exist as a mixture by employing such a zigzag arrangement. By this, the water drainage property becomes uneven, which enables stepwise dehydration and makes it possible to inhibit generation of dehydration marks, sticking of a sheet raw material on a wire and loss of fiber or filler, or to improve rigidity in an oblique direction.

In the upper surface side layer, an upper surface side warp has a 2/2 design in which it passes over two successive upper surface side wefts, and then passes under two successive upper surface side wefts. A warp binding yarn adjacent to the upper surface side warp is formed by shifting the design of the upper surface side warp by one upper surface side weft and then repeating this successively. Described specifically, the upper surface side warp 1 is obtained by repeating a 2/2 design in which the upper surface side warp 1 passes over two successive upper surface side wefts 4' and 5' and then passes under two successive upper surface side wefts 6' and 7'. The upper surface side surface design formed by a pair of warp binding yarns 2 is also a 2/2 design. The other upper surface side warps and warp binding yarns also have a 2/2 design. A uniform surface can be formed by employing the same design for the upper surface side surface design formed by upper surface side warps and the upper surface side surface design formed by warp binding yarns. In this example, the upper surface side layer is formed into a 2/2 design but any design can be selected as needed.

By employing the above-described design of the present invention, the resulting fabric is able to have improved rigidity, oblique rigidity, wear resistance and surface property, and in addition, generation of dehydration marks, sticking of a sheet raw material on a wire and loss of fiber or filler can be inhibited.

Example 2

Figures 5A, 5B:
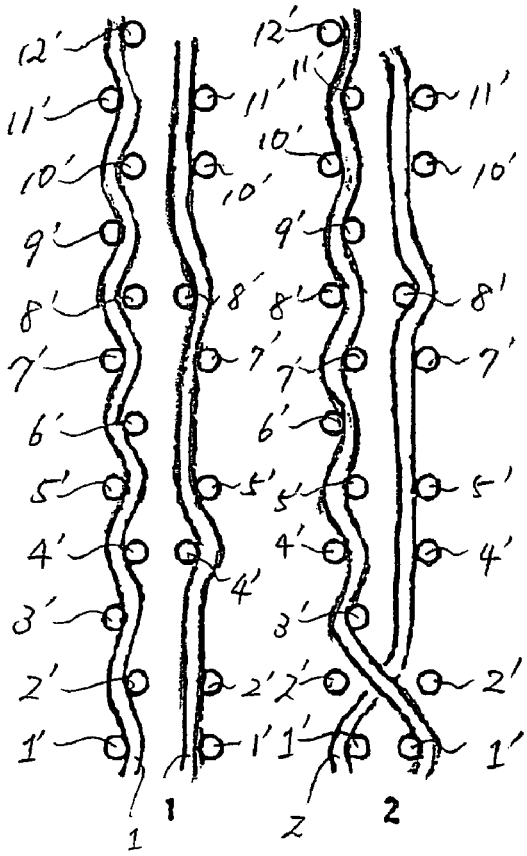
FIGS. 5A and 5B are cross-sectional views along the lines VA—VA and VB—VB at the warps 1 and 2 of FIG. 4 respectively.
Figure 6:
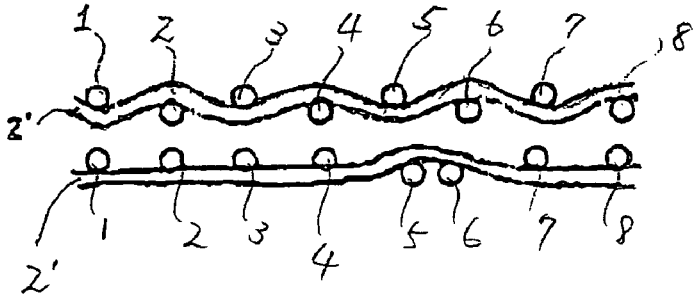
FIG. 6 is a cross-sectional view along the line VI—VI at the weft 2' of FIG. 4.

FIG. 4 is a design diagram illustrating the complete design of Example 2 of the present invention. FIGS. 5A and 5B are cross-sectional views along the lines VA—VA and VB—VB at the warps 1 and 2 of FIG. 4 respectively. FIG. 6 is a cross-sectional view along the line VI—VI at the weft 2' of FIG. 4.

In the design diagram of FIG. 4, pairs of an upper surface side warp and a lower surface side warp, of eight pairs of an upper surface side warp and lower a surface side warp vertically arranged, are indicated by 1, 3, 4, 5, 7, 8 and pairs of warp binding yarns are indicated by 2 and 6. The pairs of warp binding yarns and the pairs of an upper surface side warp and a lower surface side warp are arranged at a ratio of 1:3. Upper surface side wefts and lower surface side wefts are arranged at a ratio of 3:2. Similar to Example 1, warp binding yarns are yarns for weaving the upper surface side layer and lower surface side layer. Warp binding yarns as a pair mutually complement both the upper surface side surface design and the lower surface side surface design so that they do not break the surface design. Different from Example 1, the upper surface side layer has a plain weave design so that the upper surface side surface becomes denser than that of Example 1. As a result, the fabric has improved rigidity, oblique rigidity and surface property, and generation of dehydration marks, sticking of a sheet raw material on a wire, loss of fiber or filler can be inhibited.

Example 3

Figure 7:
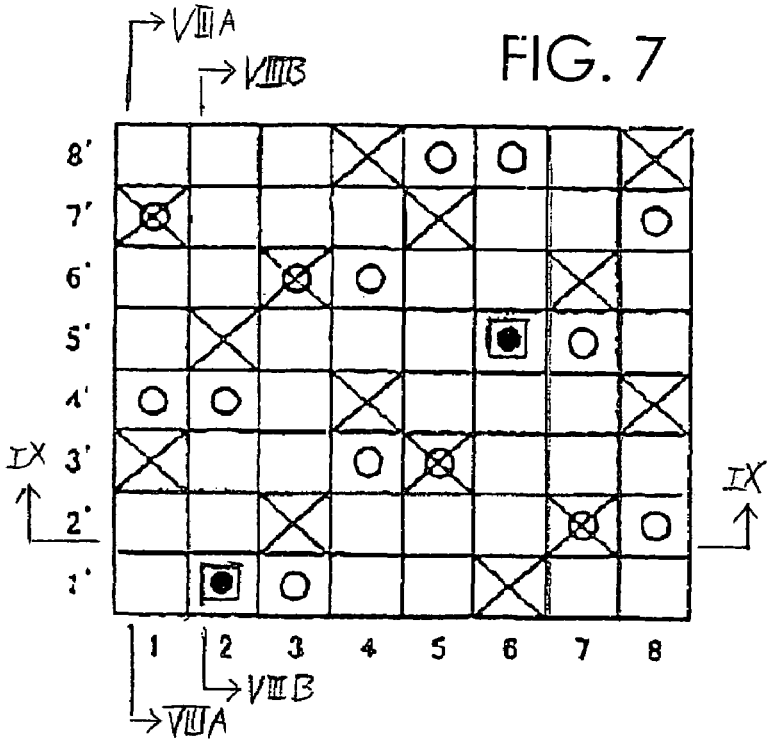
FIG. 7 is a design diagram illustrating the complete design of Example 3 of the present invention.
Figures 8A, 8B:
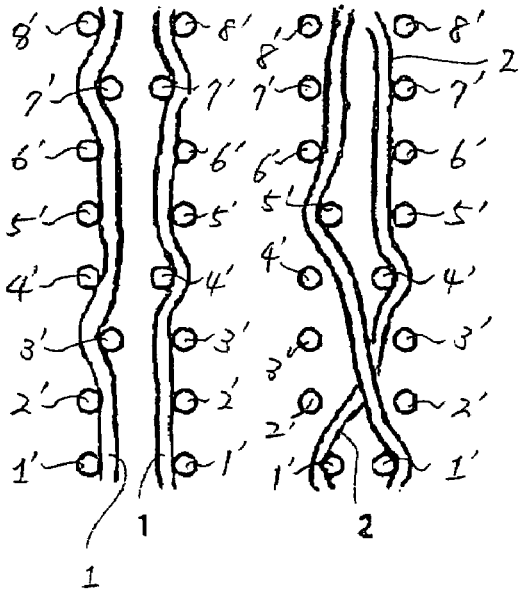
FIGS. 8A and 8B are cross-sectional views along the lines VIIIA—VIIIA and VIIIB—VIIIB at the warps 1 and 2 of FIG. 7 respectively.
Figure 9:
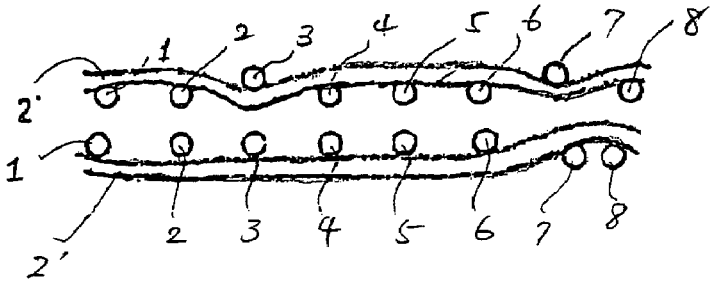
FIG. 9 is a cross-sectional view along the line IX—IX at the weft 2' of FIG. 7.

FIG. 7 is a design diagram illustrating the complete design of Example 3 of the present invention. FIGS. 8A and 8B are cross-sectional views along the lines VIIIA—VIIIA and VIIIB—VIIIB at the warps 1 and 2 of FIG. 7 respectively. FIG. 9 is a cross-sectional view along the line IX—IX at the weft 2' of FIG. 7.

In the diagram of FIG. 7, pairs of an upper surface side warp and a lower surface side warp, of eight pairs of an upper surface side warp and a lower surface side warp vertically arranged, are indicated by 1, 3, 4, 5, 7, 8 and pairs of warp binding yarns are indicated by 2 and 6. The pairs of warp binding yarns and the pairs of an upper surface side warp and a lower surface side warp are arranged at a ratio of 1:3. Upper surface side wefts and lower surface side wefts are arranged at a ratio of 1:1. The upper surface side layer has a 1/3 design so that a long crimp appears in the weft direction on the upper surface side. This improves fiber supporting property. Employment of broken twill weave breaks the regularity in an oblique direction of the upper surface side surface design, which makes it possible to suppress generation of wire marks in an oblique direction.

Example 4

Figure 10:
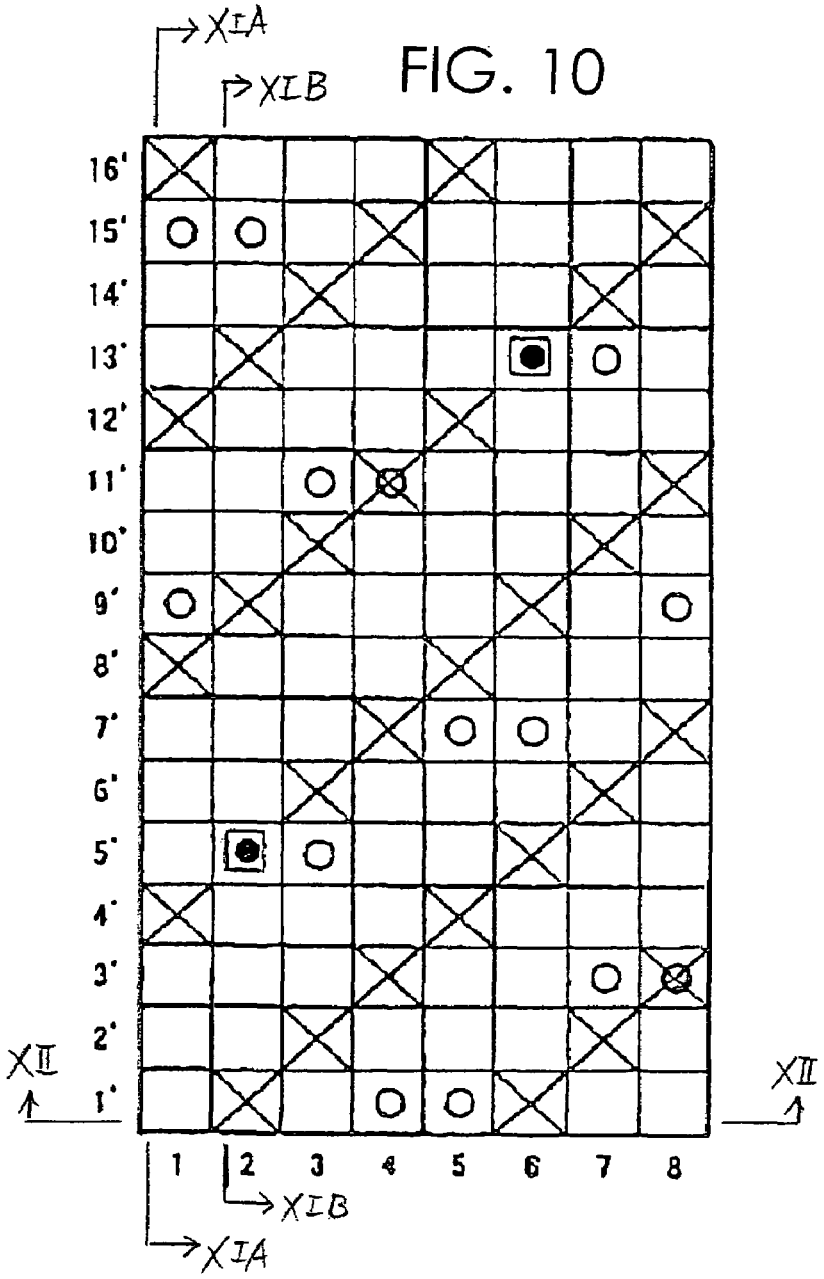
FIG. 10 is a design diagram illustrating the complete design of Example 4 of the present invention.
Figures 11A, 11B:
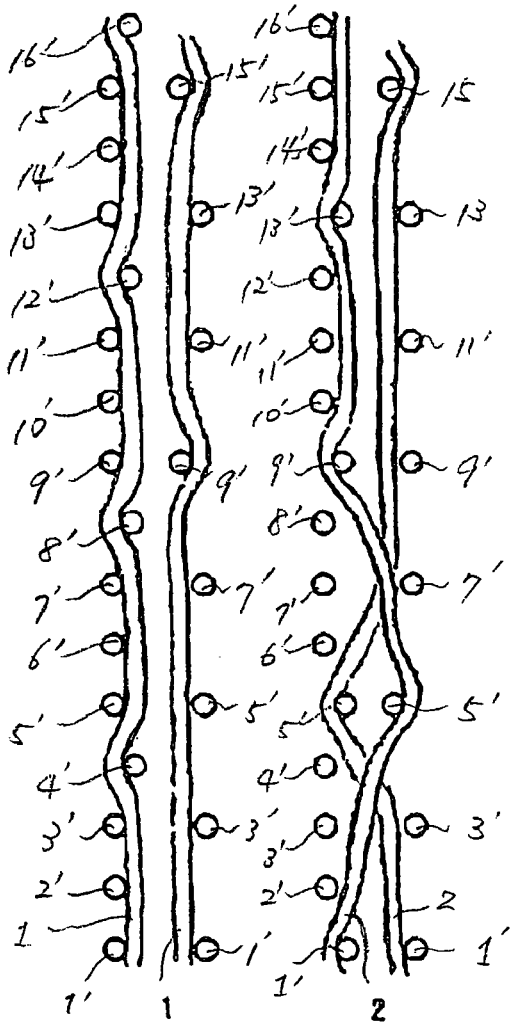
FIGS. 11A and 11B are cross-sectional views along the lines XIA—XIA and XIB—XIB at the warps 1 and 2 of FIG. 10 respectively.
Figure 12:
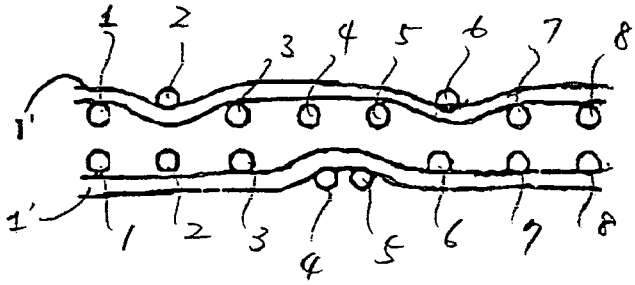
FIG. 12 is a cross-sectional view along the line XII—XII at the weft 1' of FIG. 10.

FIG. 10 is a design diagram illustrating the complete design of Example 4 of the present invention. FIGS. 11A and 11B are cross-sectional views along the lines XIA—XIA and XIB—XIB at the warps 1 and 2 of FIG. 10 respectively. FIG. 12 is a cross-sectional view along the line XII—XII at the weft 1' of FIG. 10.

In the diagram of FIG. 10, pairs of an upper surface side warp and a lower surface side warp, of eight pairs of an upper surface side warp and a lower surface side warp vertically arranged, are indicated by 1, 3, 4, 5, 7, 8 and pairs of warp binding yarns are indicated by 2 and 6. The pairs of warp binding yarns and the pairs of an upper surface side warp and a lower surface side warp are arranged at a ratio of 1:3. Upper surface side wefts and lower surface side wefts are arranged at a ratio of 2:1. The upper surface side layer has a 1/3 design so that a long crimp appears in the weft direction on the upper surface side. This improves fiber supporting property.

Example 5

Figure 13:
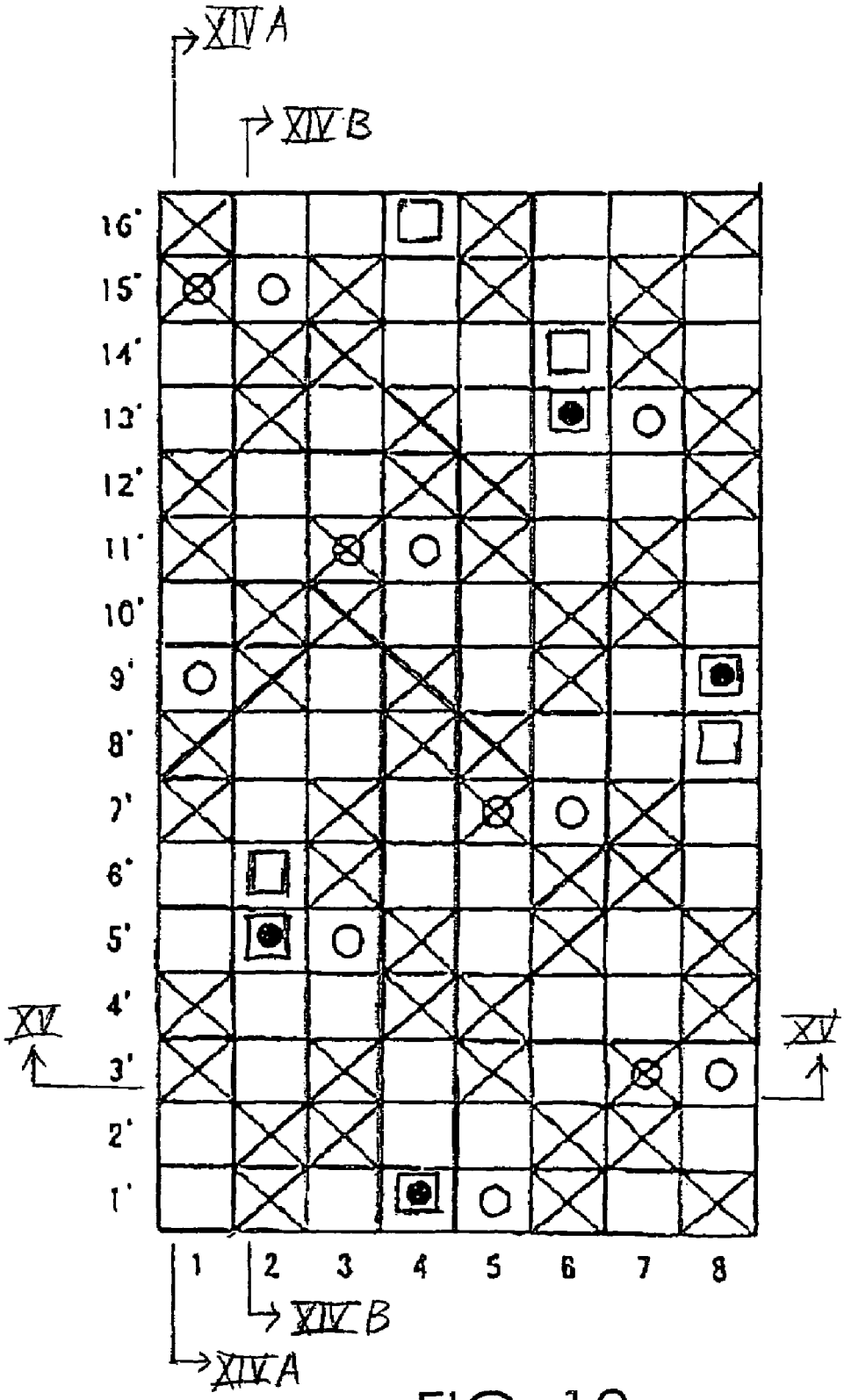
FIG. 13 is a design diagram illustrating the complete design of Example 5 of the present invention.
Figures 14A, 14B:
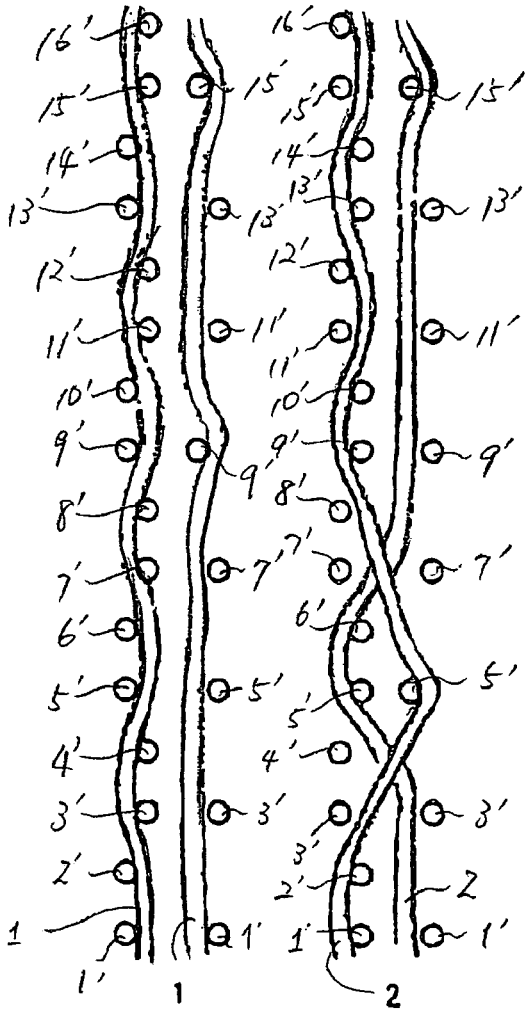
FIGS. 14A and 14B are cross-sectional views along the lines XIVA—XIVA and XIVB—XIVB at the warps 1 and 2 of FIG. 13 respectively.
Figure 15:
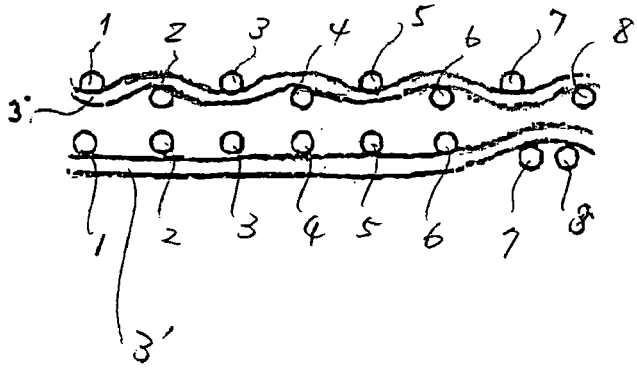
FIG. 15 is a cross-sectional view along the line XV—XV at the weft 3' of FIG. 13.

FIG. 13 is a design diagram illustrating the complete design of Example 5 of the present invention. FIGS. 14A and 14B are cross-sectional views along the lines XIVA—XIVA and XIVB—XIVB at the warps 1 and 2 of FIG. 13 respectively. FIG. 15 is a cross-sectional view along the line XV—XV at the weft 3' of FIG. 13.

In the design diagram of FIG. 13, pairs of an upper surface side warp and a lower surface side warp, of eight pairs of an upper surface side warp and a lower surface side warp vertically arranged, are indicated by 1, 3, 5, and 7 and pairs of warp binding yarns are indicated by 2, 4, 6 and 8. The pairs of two warp binding yarns and the pairs of an upper surface side warp and a lower surface side warp are arranged alternately. Upper surface side wefts and lower surface side wefts are arranged at a ratio of 2:1. The upper surface side layer employs a 2/2 design and broken twill weave, which makes it possible to break the regularity of the upper surface side surface design in an oblique direction, thereby inhibiting the generation of wire marks.

Example 6

Figure 16:
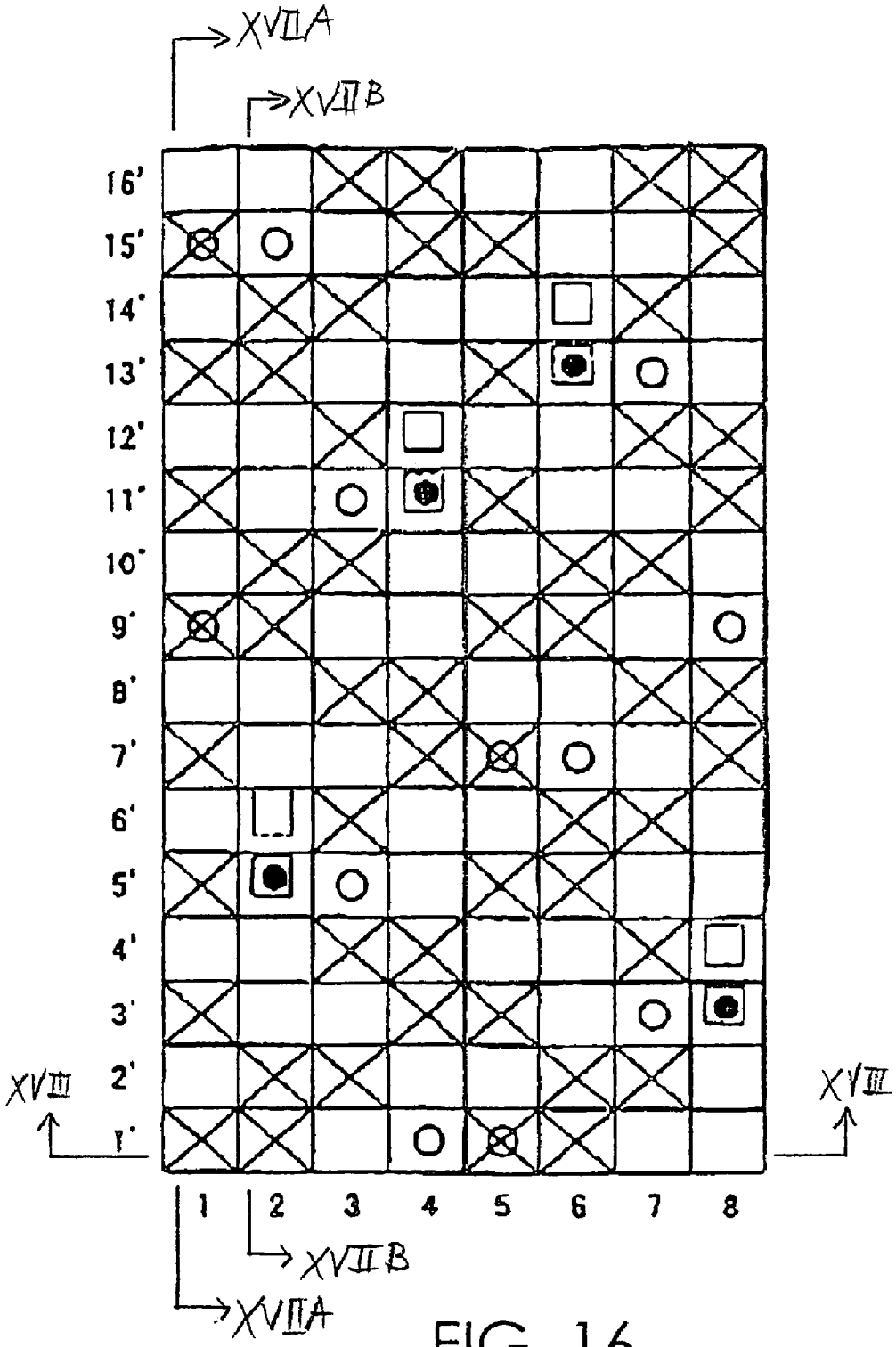
FIG. 16 is a design diagram illustrating the complete design of Example 6 of the present invention.
Figures 17A, 17B:
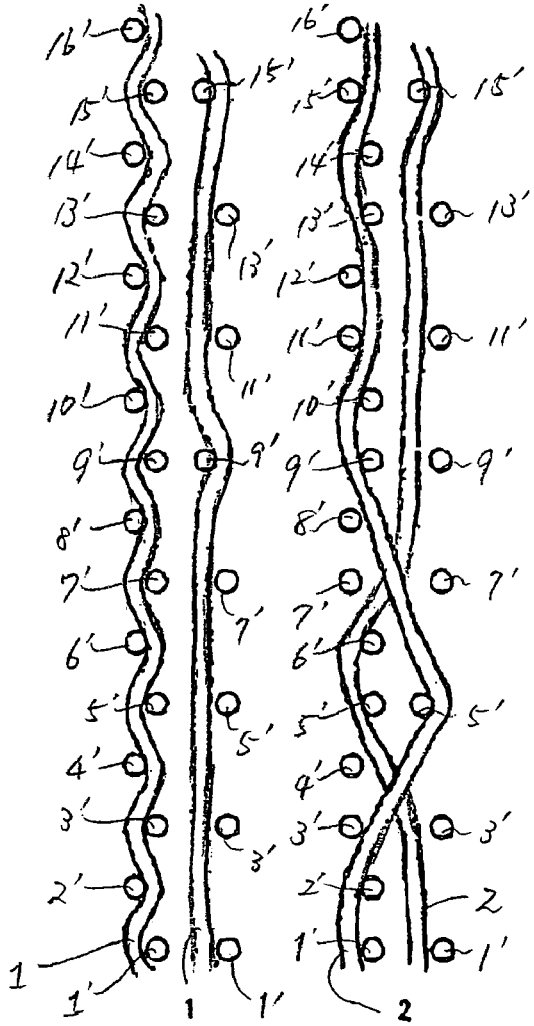
FIGS. 17A and 17B are cross-sectional views along the line XVIIA—XVIIA and XVIIB—XVIIB at the warps 1 and 2 of FIG. 16 respectively.
Figure 18:
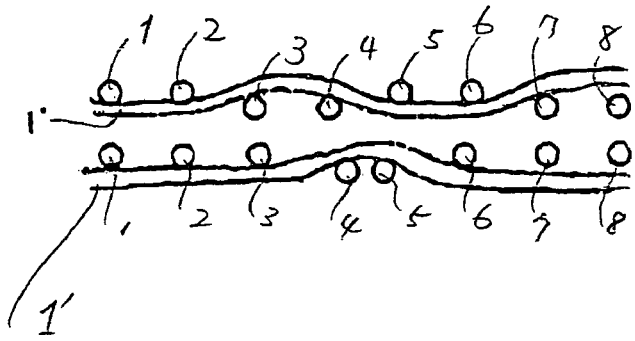
FIG. 18 is a cross-sectional view along the line XVIII—XVIII at the weft 1' of FIG. 16.

FIG. 16 is a design diagram illustrating the complete design of Example 6 of the present invention. FIGS. 17A and 17B are cross-sectional views along the line XVIIA—XVIIA and XVIIB—XVIIB at the warps 1 and 2 of FIG. 16 respectively. FIG. 18 is a cross-sectional view along the line XVIII—XVIII at the weft 1' of FIG. 16.

In the design diagram of FIG. 16, pairs of an upper surface side warp and a lower surface side warp, of eight pairs of an upper surface side warp and a lower surface side warp vertically arranged, are indicated by 1, 3, 5, and 7 and pairs of warp binding yarns are indicated by 2, 4, 6 and 8. The pairs of two warp binding yarns and the pairs of an upper surface side warp and a lower surface side warp are arranged alternately. Upper surface side wefts and lower surface side wefts are arranged at a ratio of 2:1. The warp binding yarn of the upper surface side layer forms a 2/2 design, while the upper surface side warp forms a plain weave design. Thus, the upper surface side layer is composed of two warp complete designs. Adoption of two warp complete designs makes it possible to break the regularity of the upper surface side surface design in an oblique direction and inhibits the generation of wire marks in an oblique direction.

Example 7

Figure 19:
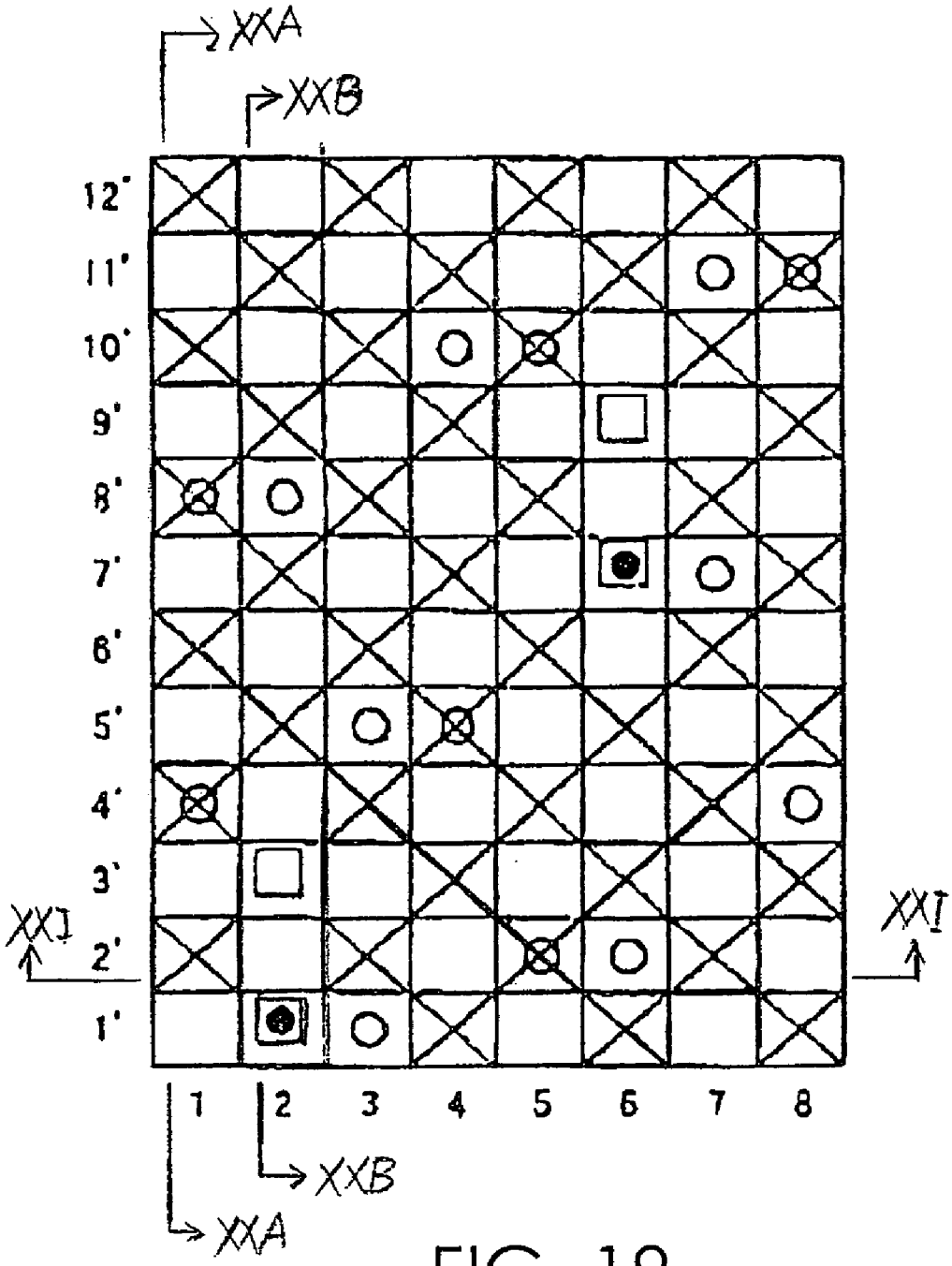
FIG. 19 is a design diagram illustrating the complete design of Example 7 of the present invention.
Figures 20A, 20B:
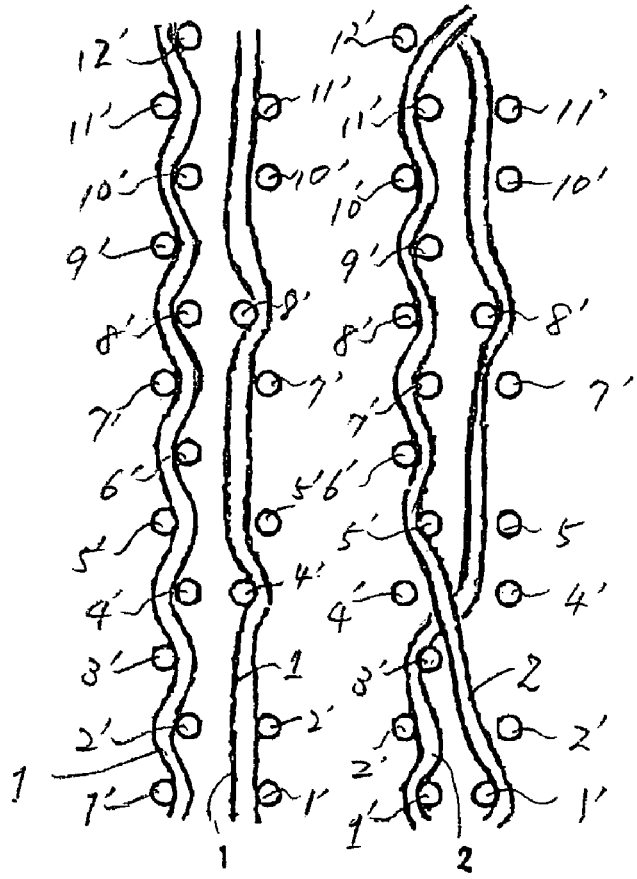
FIGS. 20A and 20B are cross-sectional views along the lines XXA—XXA and XXB—XXB at the warps 1 and 2 of FIG. 19 respectively.
Figure 21:
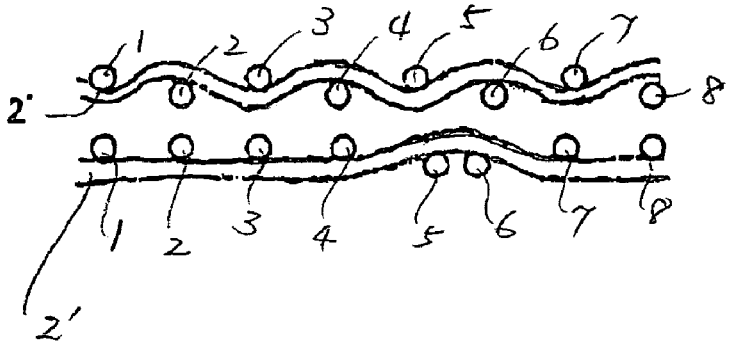
FIG. 21 is a cross-sectional view along the line XXI—XXI at the weft 2' of FIG. 19.

FIG. 19 is a design diagram illustrating the complete design of Example 7 of the present invention. FIGS. 20A and 20B are cross-sectional views along the lines XXA—XXA and XXB—XXB at the warps 1 and 2 of FIG. 19 respectively. FIG. 21 is a cross-sectional view along the line XXI—XXI at the weft 2' of FIG. 19.

In the diagram of FIG. 19, pairs of an upper surface side warp and a lower surface side warp, of eight pairs of an upper surface side warp and a lower surface side warp vertically arranged, are indicated by 1, 3, 4, 5, 7, 8 and pairs of warp binding yarns are indicated by 2 and 6. The pairs of warp binding yarns and the pairs of an upper surface side warp and a lower surface side warp are arranged at a ratio of 1:3. Upper surface side wefts and lower surface side wefts are arranged at a ratio of 3:2. The upper surface side layer is formed with a plain weave design so that the upper surface side surface becomes denser than that of Example 1. As a result, the fabric has improved rigidity, oblique rigidity and surface property, and generation of dehydration marks, sticking of a sheet raw material on a wire, loss of fiber or filler can be inhibited. In this example, the recess formed in the surface by the warp binding yarn is small so that the fabric has good surface property. For example, in Example 2, a warp binding yarn 2 weaves therein a lower surface side weft 1' from the lower surface side, and then weaves therein an upper surface side weft 3', thereby binding the upper surface side layer and the lower surface side layer. In this Example 7, a warp binding yarn 2 weaves therein a lower surface side weft 1' from the lower surface side and then weaves therein an upper surface side weft 5', thereby binding the two layers. In the latter case, the weaving positions of the upper surface side weft and the lower surface side weft are more distant than those of Example 2. The upper surface side layer and lower surface side layer are therefore bound while forming a gentle slope. The recess formed in the surface by the warp binding yarn is smaller and surface property is better, compared with those of Example 2.

Example 8

Figure 22:
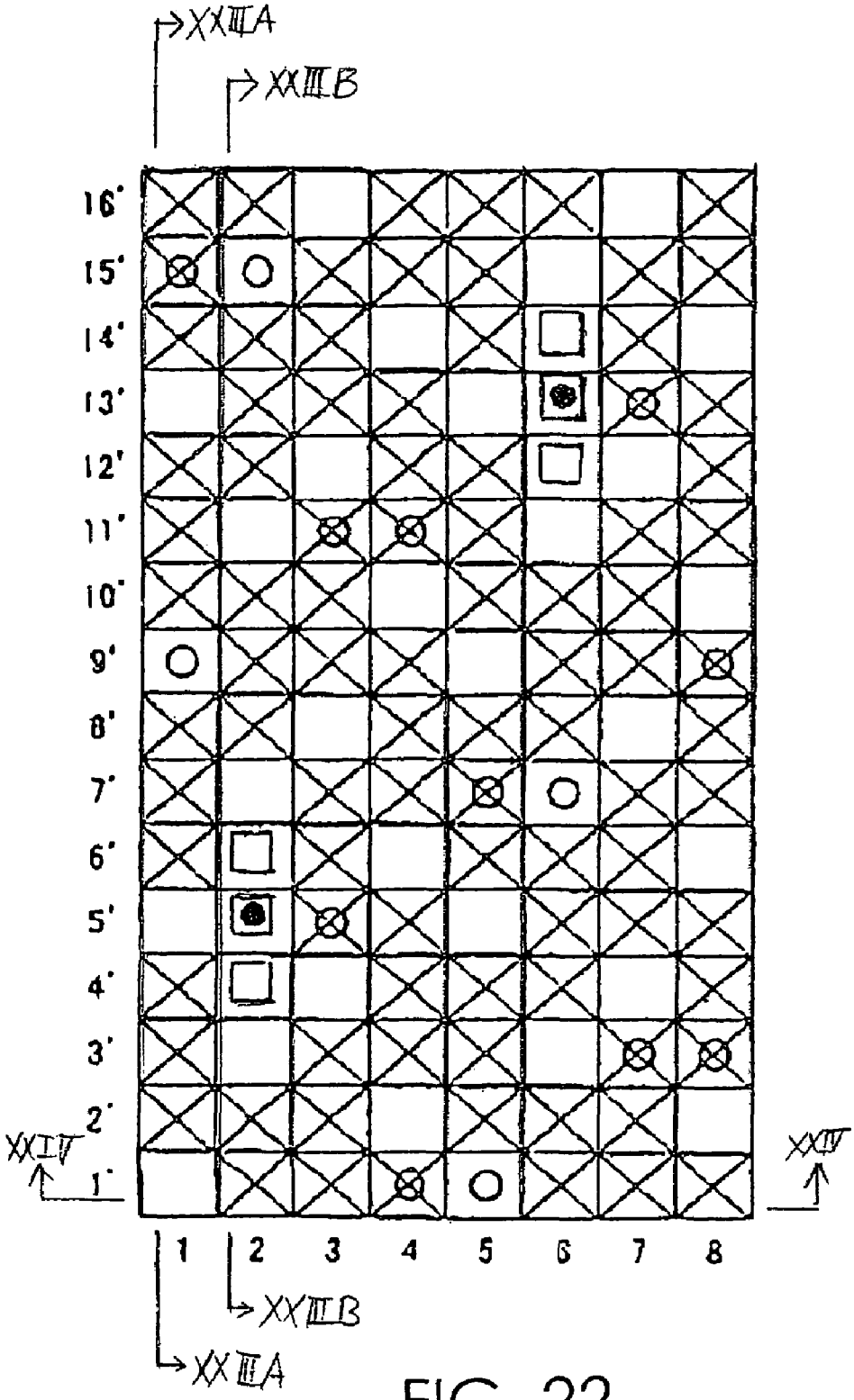
FIG. 22 is a design diagram illustrating the complete design of Example 8 of the present invention.
Figures 23A, 23B:
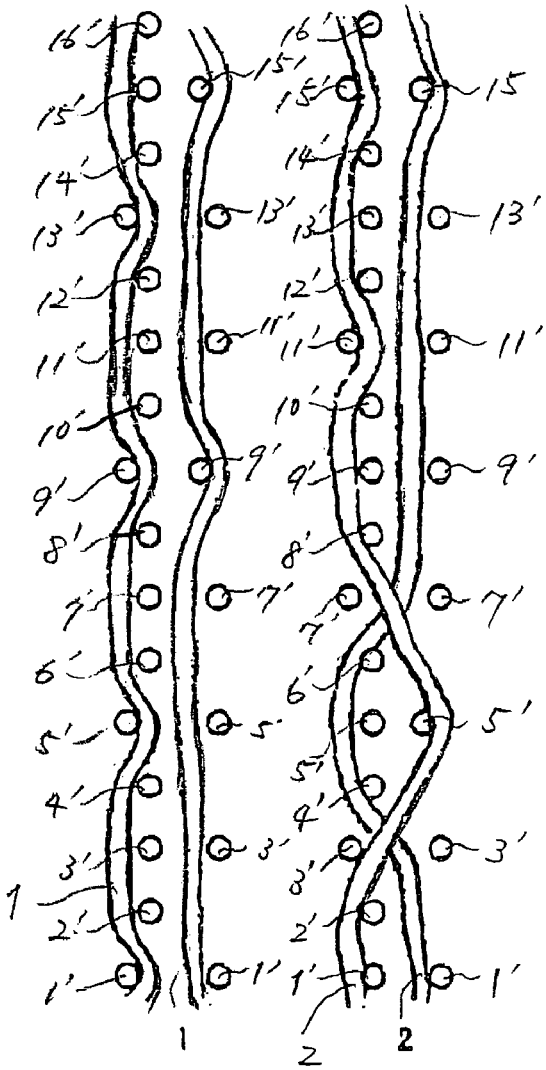
FIGS. 23A and 23B are cross-sectional views along the lines XXIIIA—XXIIIA and XXIIIB—XXIIIB at the warps 1 and 2 of FIG. 22 respectively.
Figure 24:
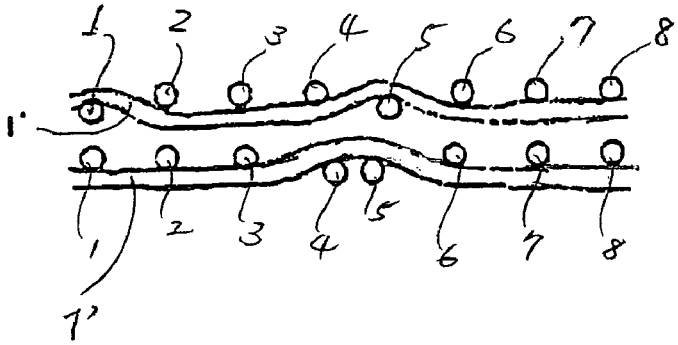
FIG. 24 is a cross-sectional view along the line XXIV—XXIV at the weft 1' of FIG. 22.

FIG. 22 is a design diagram illustrating the complete design of Example 8 of the present invention. FIGS. 23A and 23B are cross-sectional views along the lines XXIIIA—XXIIIA and XXIIIB—XXIIIB at the warps 1 and 2 of FIG. 22 respectively. FIG. 24 is a cross-sectional view along the line XXIV—XXIV at the weft 1' of FIG. 22.

In the diagram of FIG. 22, pairs of an upper surface side warp and a lower surface side warp, of eight pairs of an upper surface side warp and a lower surface side warp vertically arranged, are indicated by 1, 3, 4, 5, 7, 8 and pairs of warp binding yarns are indicated by 2 and 6. The pairs of warp binding yarns and the pairs of upper surface side warp and lower surface side warp are arranged at a ratio of 1:3. Upper surface side wefts and lower surface side wefts are arranged at a ratio of 2:1. Adoption of a 1/3 design and broken twill weave for its upper surface side layer makes it possible to break the regularity of the upper surface side surface design in an oblique direction, thereby inhibiting generation of wire marks in an oblique direction.

Example 9

Figure 25:
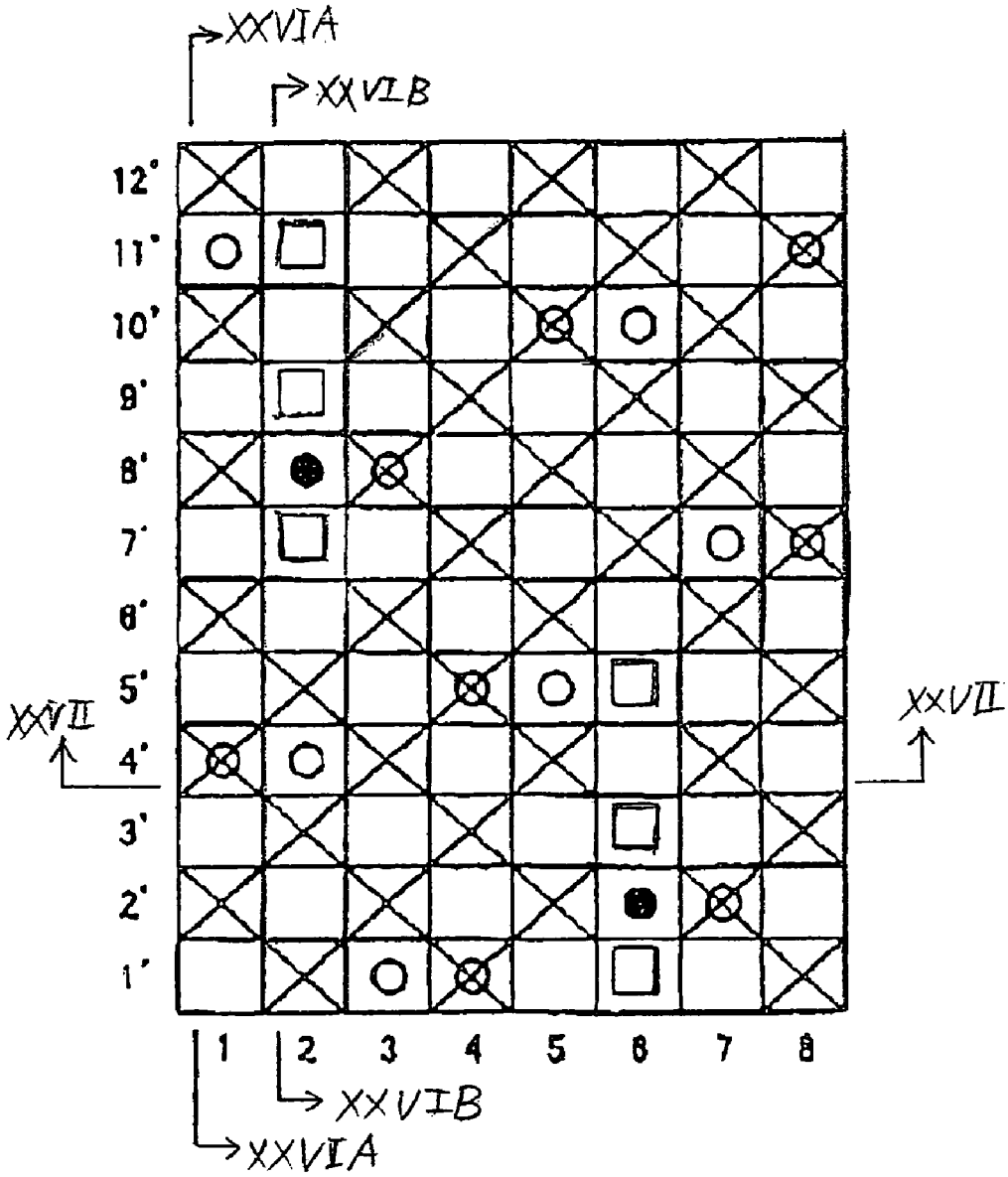
FIG. 25 is a design diagram illustrating the complete design of Example 9 of the present invention.
Figures 26A, 26B:
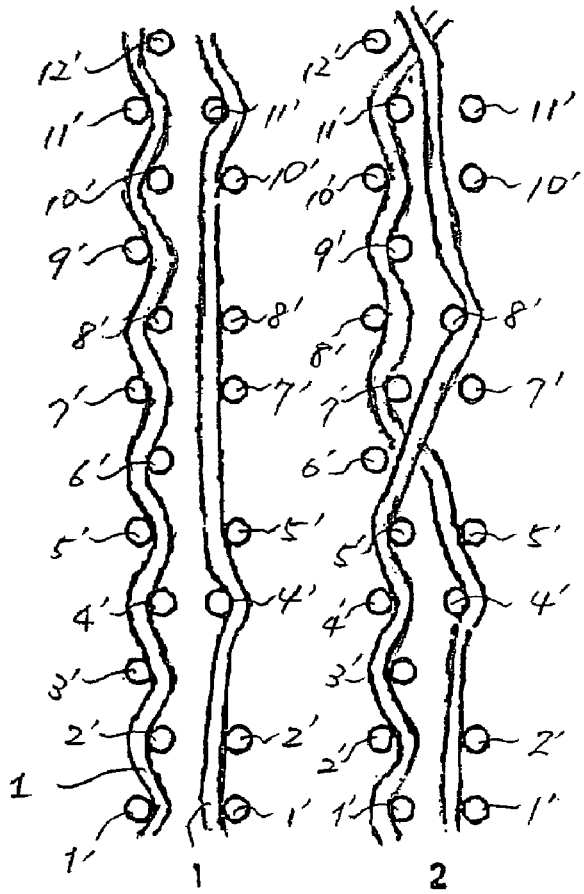
FIGS. 26A and 26B are cross-sectional views along the lines XXVIA—XXVIA and XXVIB—XXVIB at the warps 1 and 2 of FIG. 25 respectively.

FIG. 25 is a design diagram illustrating the complete design of Example 9 of the present invention. FIGS. 26A and 26B are cross-sectional views along the lines XXVIA—

Figure 27:
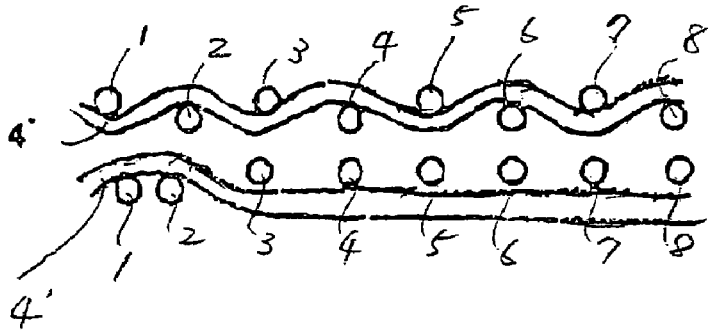
FIG. 27 is a cross-sectional view along the line XXVII—XXVII at the weft 4' of FIG. 25.

XXVIA and XXVIB—XXVIB at the warps 1 and 2 of FIG. 25 respectively. FIG. 27 is a cross-sectional view along the line XXVII—XXVII at the weft 4' of FIG. 25.

In the diagram of FIG. 25, pairs of an upper surface side warp and a lower surface side warp, of eight pairs of an upper surface side warp and a lower surface side warp vertically arranged, are indicated by 1, 3, 4, 5, 7, 8 and pairs of warp binding yarns are indicated by 2 and 6. The pairs of warp binding yarns and the pairs of an upper surface side warp and a lower surface side warp are arranged at a ratio of 1:3. Upper surface side wefts and lower surface side wefts are arranged at a ratio of 3:2. The upper surface side layer is formed with a plain weave design so that it becomes denser than that of Example 1. As a result, the fabric has improved rigidity, oblique rigidity and surface property, and generation of dehydration marks, sticking of a sheet raw material on a wire, loss of fiber or filler can be inhibited.

Example 10

Figure 28:
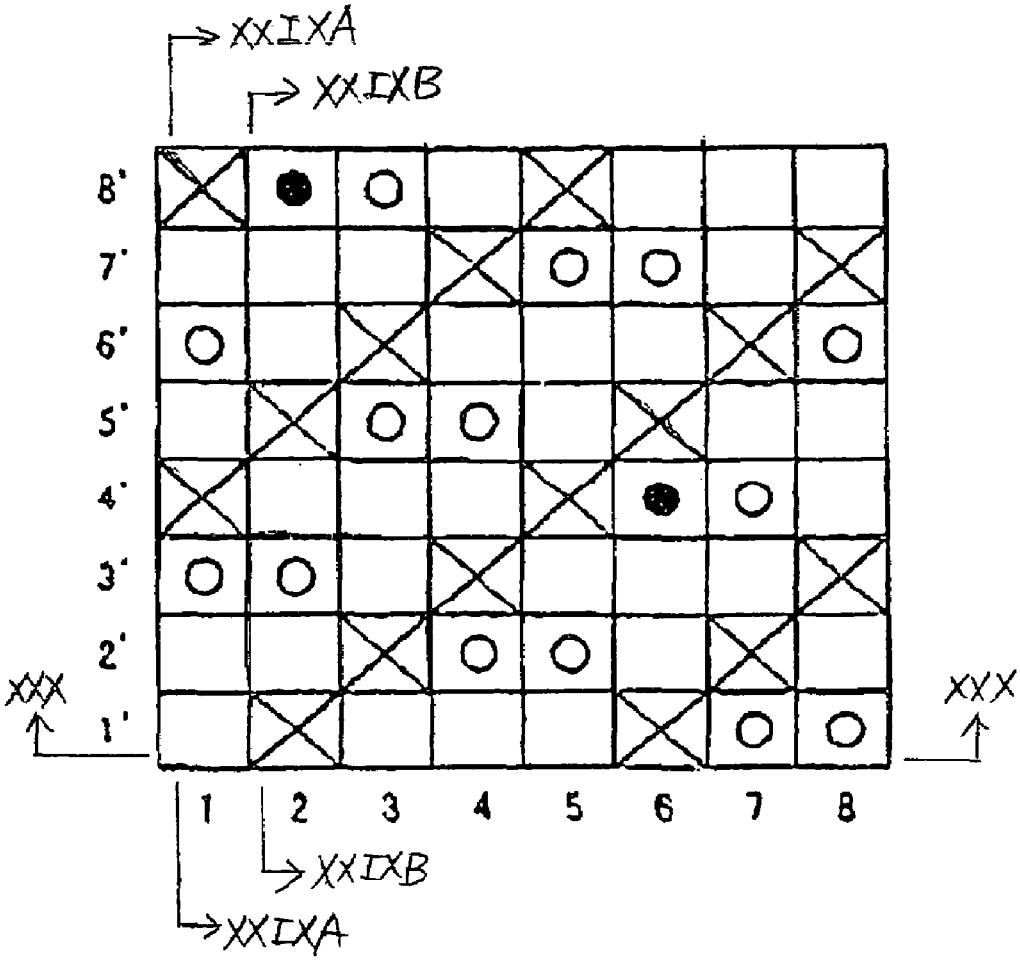
FIG. 28 is a design diagram illustrating the complete design of Example 10 of the present invention.
Figures 29A, 29B:
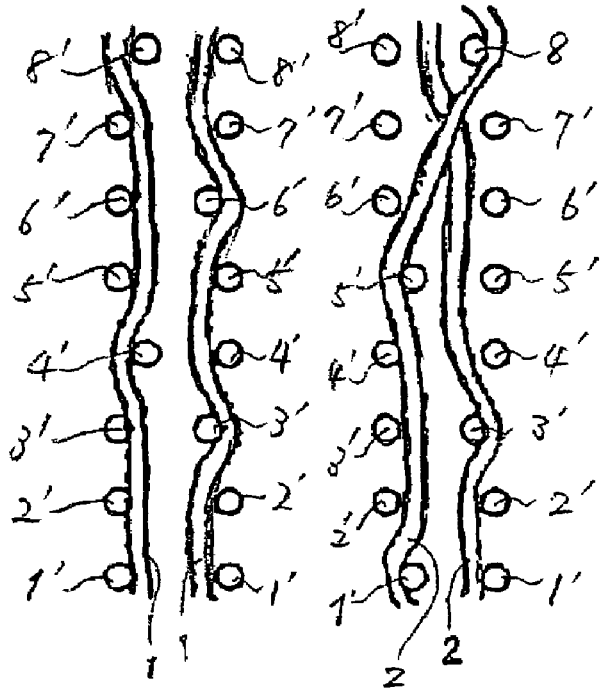
FIGS. 29A and 29B are cross-sectional views along the lines XXIXA—XXIXA and XXIXB—XXIXB at the warps 1 and 2 of FIG. 28 respectively.
Figure 30:
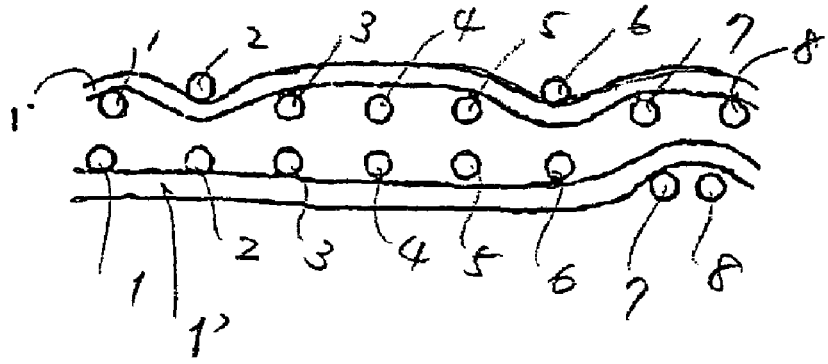
FIG. 30 is a cross-sectional view along the line XXX—XXX at the weft 1' of FIG. 28.

FIG. 28 is a design diagram illustrating the complete design of Example 10 of the present invention. FIGS. 29A and 29B are cross-sectional views along the lines XXIXA—XXIXA and XXIXB—XXIXB at the warps 1 and 2 of FIG. 28 respectively. FIG. 30 is a cross-sectional view along the line XXX—XXX at the weft 1' of FIG. 28.

In the diagram of FIG. 28, pairs of an upper surface side warp and a lower surface side warp, of eight pairs of an upper surface side warp and a lower surface side warp vertically arranged, are indicated by 1, 3, 4, 5, 7, 8 and pairs of a warp binding yarn and a lower surface side warp are indicated by 2 and 6. In the pair of a warp binding yarn and a lower surface side warp, the warp binding yarn is woven with an upper surface side weft on the upper surface side surface and functions as one warp constituting the upper surface side complete design, while, on the lower surface side, the warp binding yarn and the lower surface side warp cooperatively form a lower surface side surface design similar to that formed by the other lower surface side warp. The pairs of a warp binding yarn and a lower surface side warp and the pairs of an upper surface side warp and a lower surface side warp are arranged at a ratio of 1:3. Upper surface side wefts and lower surface side wefts are arranged at a ratio of 1:1. In Examples 1 to 9, at least one pair of warp binding yarns is located in the complete design. In the fabric of this Example, on the other hand, not a pair of warp binding yarns but two pairs of a warp binding yarn and a lower surface side warp are arranged. Such a pair of a warp binding yarn and a lower surface side warp also exhibits sufficient binding strength.

Example 11

Figure 31:
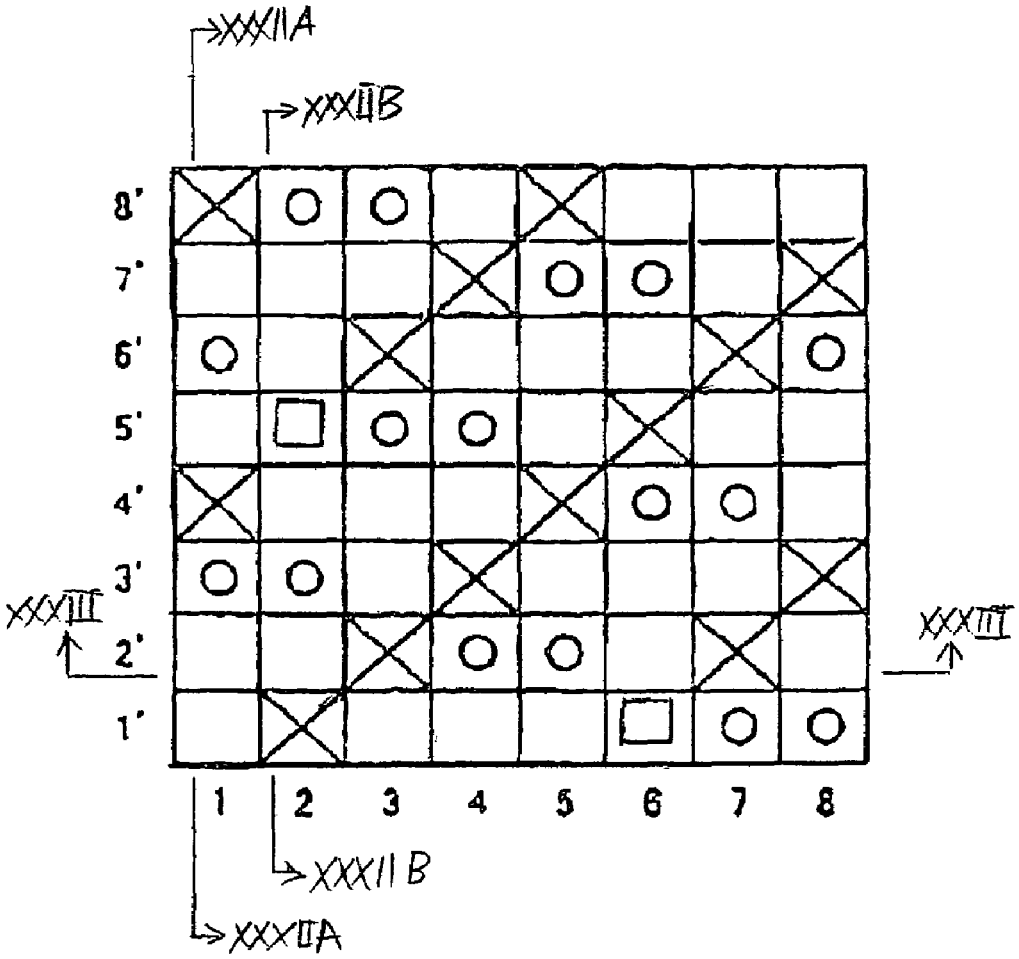
FIG. 31 is a design diagram illustrating the complete design of Example 11 of the present invention.
Figures 32A, 32B:
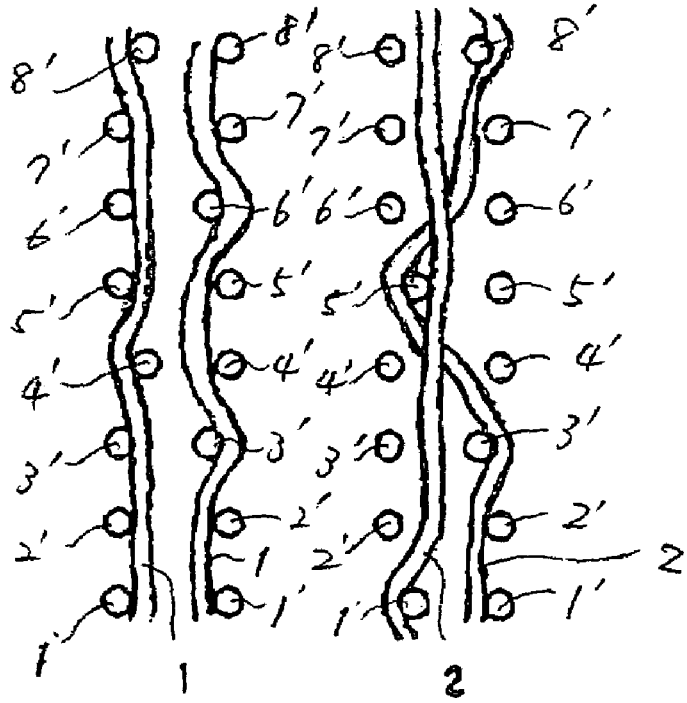
FIGS. 32A and 32B are cross-sectional views along the line XXXIIA—XXXIIA and XXXIIB—XXXIIB at the warps 1 and 2 of FIG. 31 respectively.
Figure 33:
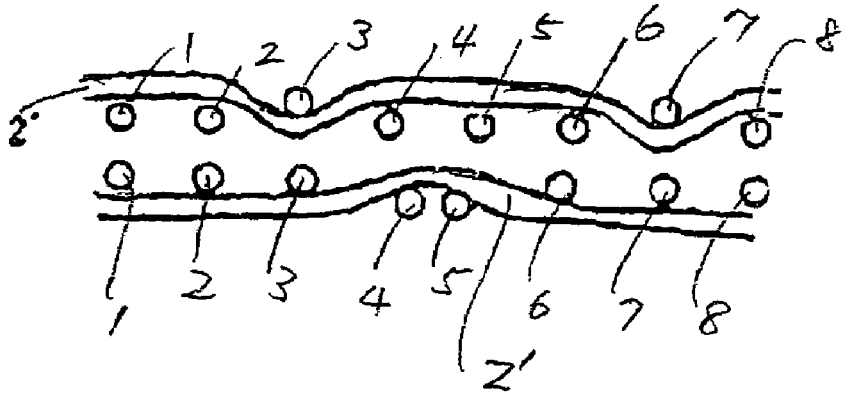
FIG. 33 is a cross-sectional view along the line XXIII—XXIII at the weft 2' of FIG. 31.

FIG. 31 is a design diagram illustrating the complete design of Example 12 of the present invention. FIGS. 32A and 32B are cross-sectional views along the line XXXIIA—XXXIIA and XXXIIB—XXXIIB at the warps 1 and 2 of FIG. 31 respectively. FIG. 33 is a cross-sectional view along the line XXXIII—XXXIII at the weft 2' of FIG. 31.

In the diagram of FIG. 31, pairs of an upper surface side warp and a lower surface side warp, of eight pairs of an upper surface side warp and a lower surface side warp vertically arranged, are indicated by 1, 3, 4, 5, 7, 8 and pairs of a warp binding yarn and an upper surface side warp are indicated by 2 and 6. In the pair of a warp binding yarn and an upper surface side warp, the warp binding yarn and upper surface side warp are woven with respective upper surface side wefts on the upper surface side surface and cooperatively function as one warp constituting an upper surface side complete design, while on the lower surface side, the warp binding yarn forms a lower surface side surface design similar to that of a lower surface side warp. The pairs of a warp binding yarn and an upper surface side warp and the pairs of an upper surface side warp and a lower surface side warp are arranged at a ratio of 1:3. Upper surface side wefts and lower surface side wefts are arranged at a ratio of 1:1. In this Example, not a pair of warp binding yarns but two pairs of a warp binding yarn and a lower surface side warp are arranged. Such a pair of a warp binding yarn and an upper surface side warp also exhibits sufficient binding strength.

The present invention prevents generation of dehydration marks, sticking of fibers on a wire and loss of fibers. Such a fabric has excellent utility as a papermaking wire.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2004-242258 filed Aug. 23, 2004 including specification, drawings and claims is incorporated herein by reference in its entirety.

What is claimed is:

1. An industrial two-layer fabric which comprises eight pairs of warps obtained by arranging eight upper surface side warps and eight lower surface side warps, and a plurality of upper surface side wefts and lower surface side wefts, and has an upper surface side layer and a lower surface side layer bound with warp-direction yarns, wherein:

in the lower surface side layer, warps are formed by successively arranging a design in which one warp passes over four successive lower surface side wefts, passes under one lower surface side weft, passes over two lower surface side wefts, and passes under one lower surface side weft while shifting the design by three lower surface side wefts, and two adjacent lower surface side warps simultaneously weave therein, from the lower surface side, one lower surface side weft, thereby forming a weft long crimp of the lower surface side weft corresponding to six lower surface side warps over the lower surface side surface and at the same time, arranging a lower surface side warp in a zigzag manner while alternately adjoining lower surface side warps on both sides adjacent thereto.

2. The industrial two-layer fabric according to claim 1, wherein the upper surface side warp and lower surface side warp of at least one of the eight pairs of an upper surface side warp and a lower surface side warp arranged vertically are both warp binding yarns which are woven with an upper surface side weft and a lower surface side weft to constitute a portion of an upper surface side surface design and a portion of a lower surface side surface design; the warp binding yarns as the pair are woven with respective upper surface side wefts and cooperatively function as one warp constituting an upper surface side complete design on an upper surface side surface, while on the lower surface side surface, the pair of warp binding yarns constitutes a lower surface side surface design similar to that constituted by a lower surface side warp.

3. The industrial two-layer fabric according to claim 1, wherein the upper surface side warp of at least one of the eight pairs of an upper surface side warp and a lower surface side warp arranged vertically is a warp binding yarn which is woven with an upper surface side weft and a lower surface side weft to constitute a portion of an upper surface side surface design and a portion of a lower surface side surface design; in the pair of a warp binding yarn and a lower surface side warp, the warp binding yarn is woven with an upper surface side weft to function as one warp constituting an upper surface side complete design on an upper surface side surface, while on the lower surface side surface, the pair of a warp binding yarn and a lower surface side warp cooperatively constitutes a lower surface side surface design similar to that constituted by the other lower surface side warp.

4. The industrial two-layer fabric according to claim 1, wherein the lower surface side warp of at least one of the eight pairs of an upper surface side warp and a lower surface side warp arranged vertically is a warp binding yarn which is woven with an upper surface side weft and a lower surface side weft to constitute a portion of an upper surface side surface design and a portion of a lower surface side surface design; in the pair of a warp binding yarn and an upper surface side warp, the warp binding yarn and the upper surface side warp are woven with respective upper surface side wefts and cooperatively function as one warp constituting an upper surface side complete design on an upper surface side surface, while on the lower surface side surface, the warp binding yarn constitutes a lower surface side surface design similar to that formed by a lower surface side warp.

5. The industrial two-layer fabric, wherein one of warp binding yarns forming a pair as claimed in claim 2 is woven with at least one upper surface side weft to form an upper surface side surface design, under which the other warp binding yarn is woven with one lower surface side weft, while the one warp binding yarn is woven with one lower surface side weft, over which the other warp binding yarn is woven with at least one upper surface side weft to constitute the upper surface side surface design; thus, the pair of warp binding yarns mutually complement the upper surface side surface design and lower surface side surface design, thereby forming each surface design.

6. The industrial two-layer fabric according to claim 1, wherein the upper surface side complete design is composed of one warp complete design.

7. The industrial two-layer fabric according to claim 1, wherein the upper surface side complete design is composed of at least two warp complete designs.

8. The industrial two-layer fabric according to claim 1, wherein the upper surface side surface design is any one of 2-shaft plain weave, 4-shaft twill weave, 4-shaft broken twill weave, 8-shaft twill weave and 8-shaft broken twill weave.

9. The industrial two-layer fabric according to claim 1, wherein one or at least two auxiliary wefts are arranged between the upper surface side wefts.

10. The industrial two-layer fabric according to claim 1, wherein the number of upper surface side wefts is 1 to 2 times the number of lower surface side wefts.

11. The industrial two-layer fabric as described in claim 1, wherein the diameter of the upper surface side warp is equal to that of the lower surface side warp.

* * * * *